US009533846B2

(12) United States Patent
Ishii et al.

(10) Patent No.: US 9,533,846 B2
(45) Date of Patent: Jan. 3, 2017

(54) DRAWER UNIT, AND IMAGE FORMING APPARATUS USING THE DRAWER UNIT

(71) Applicants: Hiroshi Ishii, Kanagawa (JP); Kohta Takenaka, Kanagawa (JP); Kouta Hirakawa, Tokyo (JP); Hidehiko Maeda, Tokyo (JP); Gaku Hosono, Kanagawa (JP)

(72) Inventors: Hiroshi Ishii, Kanagawa (JP); Kohta Takenaka, Kanagawa (JP); Kouta Hirakawa, Tokyo (JP); Hidehiko Maeda, Tokyo (JP); Gaku Hosono, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/982,176

(22) Filed: Dec. 29, 2015

(65) Prior Publication Data

US 2016/0221770 A1 Aug. 4, 2016

(30) Foreign Application Priority Data

Jan. 30, 2015 (JP) ..... 2015-016405
Sep. 10, 2015 (JP) ..... 2015-178430

(51) Int. Cl.
*G03G 21/00* (2006.01)
*B65H 1/26* (2006.01)
*G03G 21/16* (2006.01)

(52) U.S. Cl.
CPC ..... *B65H 1/266* (2013.01); *G03G 21/1623* (2013.01); *G03G 21/1661* (2013.01);
(Continued)

(58) Field of Classification Search
CPC ..... G03G 21/2661; G03G 21/1623; G03G 21/1633; G03G 2221/1654; G03G 2221/1672; G03G 2221/1684; B65H 1/226; B65H 1/266
(Continued)

(56) References Cited

U.S. PATENT DOCUMENTS

2007/0053716 A1 3/2007 Itabashi
2008/0317510 A1 12/2008 Choi et al.
(Continued)

FOREIGN PATENT DOCUMENTS

EP 2009510 A1 12/2008
JP 2004-154322 6/2004
(Continued)

OTHER PUBLICATIONS

Extended European Search Report dated May 30, 2016.

*Primary Examiner* — Robert Beatty
(74) *Attorney, Agent, or Firm* — Harness, Dickey & Pierce, P.L.C.

(57) ABSTRACT

A drawer unit including a housing and a drawer inserted into the housing in inserting direction and drawn therefrom in drawing direction is provided. A locking member is mounted on the housing or the drawer to extend in direction intersecting the inserting direction, and is rotatable on a rotating shaft extending in the inserting direction such that when the drawer is inserted, the locking member rotates from unlock position to lock position in locking direction while rotating from the lock position to the unlock position in unlocking direction prior to drawing of the drawer. A locking wall and a pushing wall are mounted on the other of the housing and the drawer. The locking member in the lock position is engaged with the locking wall. When being rotated in the unlocking direction, the locking member is contacted with
(Continued)

the pushing wall, which pushes the drawer in the drawing direction.

17 Claims, 17 Drawing Sheets

(52) U.S. Cl.
CPC . *G03G 21/1614* (2013.01); *G03G 2221/1654* (2013.01); *G03G 2221/1684* (2013.01)

(58) Field of Classification Search
USPC ..... 399/110, 124
See application file for complete search history.

(56) References Cited

U.S. PATENT DOCUMENTS

| | | | | |
|---|---|---|---|---|
| 2014/0167580 | A1 | 6/2014 | Funayama et al. | |
| 2014/0169828 | A1* | 6/2014 | Ohta ..... | G03G 15/6502 399/110 |

FOREIGN PATENT DOCUMENTS

| | | |
|---|---|---|
| JP | 2012-245311 | 12/2012 |
| JP | 2014-134753 | 7/2014 |

* cited by examiner

DRAWER UNIT, AND IMAGE FORMING APPARATUS USING THE DRAWER UNIT

CROSS-REFERENCE TO RELATED APPLICATIONS

This patent application is based on and claims priority pursuant to 35 U.S.C. §119 to Japanese Patent Applications Nos. 2015-016405 and 2015-178430, filed on Jan. 30, 2015 and Sep. 10, 2015, respectively, in the Japan Patent Office, the entire disclosure of which is hereby incorporated by reference herein.

BACKGROUND

Technical Field

This disclosure relates to a drawer unit, and to an image forming apparatus using the drawer unit.

Description of the Related Art

There is an electrophotographic image forming apparatus, which includes a drawer unit including a housing and a drawer detachably attachable to the housing. The drawer includes one or more of constituent parts used for forming a toner image on a surface of a recording medium sheet and fixing the toner image on the recording medium sheet. When the recording medium sheet jams in an image forming operation or when maintenance of the constituent parts is performed, inserting and drawing of the drawer are performed.

In such an image forming apparatus, when the force (hereinafter referred to as drawing force) needed for drawing the drawer from the housing of the image forming apparatus is large, the drawing operation is a burden to a powerless user. There is a proposal for a drawer unit which is not a drawer of image forming apparatus and which includes a main drawer and an inner drawer connected with the main drawer, wherein the total drawing force needed for drawing the main and inner drawers is reduced. Specifically, in this drawer unit, the drawing force needed for drawing one of the drawers located at a position distant from the handle of the drawers is set to be smaller than that needed for the other drawer closer to the handle to reduce the total drawing force.

In addition, there is a proposal for a drawer equipped with a push-lock mechanism, which includes a spring, wherein, when the drawer is inserted, the spring is compressed while locking the drawer. In order to draw the locked drawer, the drawer is slightly pushed to unlock the push-lock mechanism. In this case, the drawer is pushed in the drawing direction by the resilience of the spring.

SUMMARY

As an aspect of this disclosure, a drawer unit is provided which includes a housing, and a drawer which is inserted into the housing in an inserting direction and is drawn from the housing in a drawing direction opposite to the inserting direction, a locking member which is mounted on the housing or the drawer, and a locking wall and a pushing wall which are mounted on the other of the housing and the drawer. The locking member extends in a direction intersecting the inserting direction, and is rotatable on a rotating shaft extending in the inserting direction. When the drawer is inserted into the housing, the locking member rotates from a predetermined unlock position to a predetermined lock position in a locking direction. In addition, the locking member rotates from the lock position to the unlock position in an unlocking direction prior to drawing of the drawer.

When the locking member is in the lock position, the locking member is engaged with the locking wall. When the locking member is rotated in the unlocking direction, the locking member is contacted with the pushing wall, and the pushing wall pushes the drawer in the drawing direction as the locking member rotates in the unlocking direction.

As another aspect of this disclosure, an image forming apparatus is provided which includes image forming members to form and fix a toner image on a recording medium sheet, and the above-mentioned drawer unit, wherein one or more of the image forming members are mounted on the drawer unit.

The aforementioned and other aspects, features and advantages will become apparent upon consideration of the following description of the preferred embodiments taken in conjunction with the accompanying drawings.

DETAILED DESCRIPTION

Figure 1:
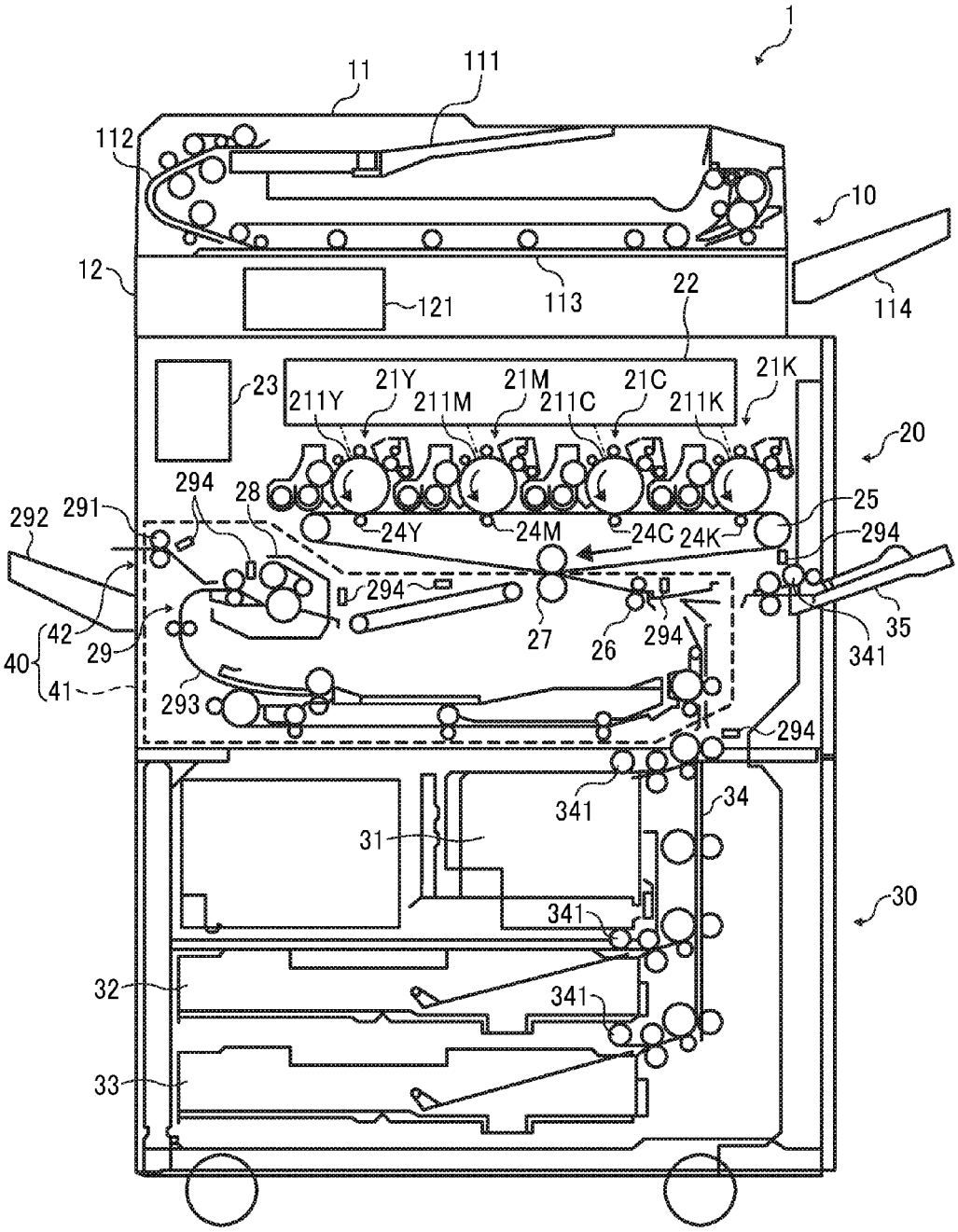
FIG. 1 is a schematic view illustrating an image forming apparatus according to an embodiment of this disclosure.

Since the above-mentioned drawer unit including a main drawer and an inner drawer is predicated on that the two drawers are drawn in combination, such a drawer unit is not useful for image forming apparatus because image forming apparatus do not need such a drawer.

In addition, the above-mentioned drawer equipped with a push-lock mechanism is not useful for image forming apparatus because the resilience of spring is too small to reduce the drawing force needed for drawing a drawer of image forming apparatus.

Thus, there is no drawer which can be used for image forming apparatus and which has such a configuration as to reduce the drawing force needed for drawing the drawer.

The object of this disclosure is to provide a drawer unit, which can be used for image forming apparatus and which has such a configuration as to reduce the drawing force.

Hereinafter, several embodiments of this disclosure will be described by reference to drawings. Initially, a first embodiment of this disclosure will be described by reference to drawings. FIG. 1 is a schematic view illustrating an image forming apparatus according to the first embodiment. Referring to FIG. 1, an image forming apparatus 1 is a multi-functional peripheral having printing and copying functions, and includes a document reading portion 10, a main body 20, and a recording medium containing portion 30.

The document reading portion 10 includes a document feeder 11 and a document reader 12. The document feeder 11 feeds an original set on a document tray 111 to a document ejection tray 114 along a document passage 112 via a platen 113, which is a transparent plate. The document reader 12 includes a reading device 121. The reading device 121 is arranged below the platen 113 to read the image of the original, which is fed on the platen 113, while generating image data of the original. The reading device 121 sends the image data to the main body 20.

The recording medium containing portion 30 includes plural containers 31, 32 and 33, each of which contains recording medium sheets (such as paper sheets) therein, and a sheet feeding passage 34. The containers 31, 32 and 33 contain recording medium sheets having different sizes. The recording medium sheets in each of the containers 31, 32 and 33 are picked up one by one by a pickup roller 341 and fed to the main body 20. In addition, the image forming apparatus 1 includes a manual recording medium tray 35, which projects from a side wall of the main body 20. Recording medium sheets on the manual recording medium tray 35 are also picked up one by one by the pickup roller 341 and fed to the main body 20.

The main body 20 forms a full color image using four toners including yellow (Y), magenta (M), cyan (C), and black (K) toners. The main body 20 includes image forming portions 21Y, 21M, 21C and 21K, which respectively form Y, M, C and K images, and an optical writing portion 22.

The image forming apparatus 1 is a tandem image forming apparatus in which the four image forming portions 21Y, 21M, 21C and 21K are arranged side by side. The image forming portions 21Y, 21M, 21C and 21K include photoconductor drums 211Y, 211M, 211C and 211K, respectively, each of which rotates counterclockwise. The optical writing portion 22 irradiates peripheral surfaces of the photoconductor drums 211Y, 211M, 211C and 211K with light to form electrostatic latent images on the photoconductor drums. The electrostatic latent images are developed with Y, M, C and K toners, resulting in formation of Y, M, C and K toner images on the photoconductor drums 211Y, 211M, 211C and 211K, respectively.

The main body 20 includes a controller 23 to control operations of constituent elements of the image forming apparatus 1. The controller 23 receives the image data sent from the document reading portion 10, and image data generated and sent by a peripheral such as computers. Under control of the controller 23 based on the image data, the optical writing portion 22 irradiates the photoconductor drums 211Y, 211M, 211C and 211K to form electrostatic latent images thereon, and the image forming portions 21Y, 21M, 21C and 21K form Y, M, C and K toner images on the respective photoconductor drums.

The main body 20 also includes primary transfer devices 24Y, 24M, 24C and 24K, an intermediate transfer belt 25, a pair of registration rollers 26, a secondary transfer device 27, a fixing device 28 and a sheet feeding passage 29.

The intermediate transfer belt 25 rotates clockwise in FIG. 1. The Y, M, C and K toner images formed on the respective photoconductor drums 211Y, 211M, 211C and 211K are primarily transferred to the rotated intermediate transfer belt 25 by the primary transfer devices 24Y, 24M, 24C and 24K so as to be overlaid, thereby forming a combined color toner image on the intermediate transfer belt 25. Since the intermediate transfer belt 25 rotates, the combined color toner image thereon is then fed to the secondary transfer device 27.

The recording medium sheet fed from the recording medium containing portion 30 or the manual recording medium tray 35 is temporarily stopped before the secondary transfer device 27 by the pair of registration rollers 26. The pair of registration rollers 26 timely feeds the recording medium sheet to the secondary transfer device 27 so that the combined color toner image on the intermediate transfer belt 25 is transferred to a proper position of the recording medium sheet by the secondary transfer device 27. The recording medium sheet bearing the combined color toner image thereon is fed to the fixing device 28 along the sheet feeding passage 29, and the combined color toner image is fixed to the recording medium sheet by the fixing device 28.

The image forming apparatus 1 can produce a duplex copy. Whether or not a duplex copy is produced is determined according to information input from the user or a peripheral such as computers. Specifically, when information of producing a single-sided copy is input, the recording medium sheet passing through the fixing device 28 and bearing a fixed toner image on one side thereof is ejected from the main body by a sheet ejecting roller 291 so as to be stacked on a sheet ejection tray 292.

In contrast, when information of producing a duplex copy is input, the recording medium sheet passing through the fixing device 28 and bearing a fixed toner image on one side thereof is fed to a sheet inverting passage 293. The recording medium sheet passing through the sheet inverting passage 293 is inverted so that the backside thereof faces the intermediate transfer belt 25, and the recording medium sheet is then fed to the pair of registration rollers 26. The pair of registration rollers 26 timely feeds again the recording medium sheet to the secondary transfer device 27, and another toner image on the intermediate transfer belt 25 is transferred to the backside of the recording medium sheet, followed by fixing the toner image to the backside. The recording medium sheet bearing fixed toner images thereon is ejected from the main body by the sheet ejecting roller 291 so as to be stacked on the sheet ejection tray 292, resulting in formation of a duplex copy.

Several sheet sensor 294 are arranged at various positions of the sheet feeding passage 29 to detect whether the recording medium sheet passes. Specifically, the sheet sensors 294 are arranged at a position downstream from the pickup roller 341 of the manual recording medium tray 35, a position at which the recording medium sheet in the recording medium containing portion 30 is picked up, and a position upstream from the pair of registration rollers 26. In addition, the sheet sensors 294 are arranged at a position downstream from the secondary transfer device 27, positions upstream and downstream from the fixing device 28, and a position upstream from the sheet ejection roller 291. Based on the detection results of these sheet sensors 294, the controller 23 determines the position in the sheet feeding passage 29, at which the recording medium sheet jams.

The image forming apparatus 1 has the above-mentioned configuration. In addition, the image forming apparatus 1 has a configuration such that a drawer unit 40 having a drawer 41 is provided in the main body. Specifically, constituent parts (hereinafter sometimes referred to as image forming members) located below the intermediate transfer belt 25 such as the pair of registration rollers 26, the secondary transfer device 27, the fixing device 28, and the sheet feeding passage 29 are mounted on the drawer 41. The drawer 41 is inserted into or drawn from a housing 42 of the drawer unit 40, which housing also serves as a housing of the main body 20 of the image forming apparatus 1.

Figure 2:
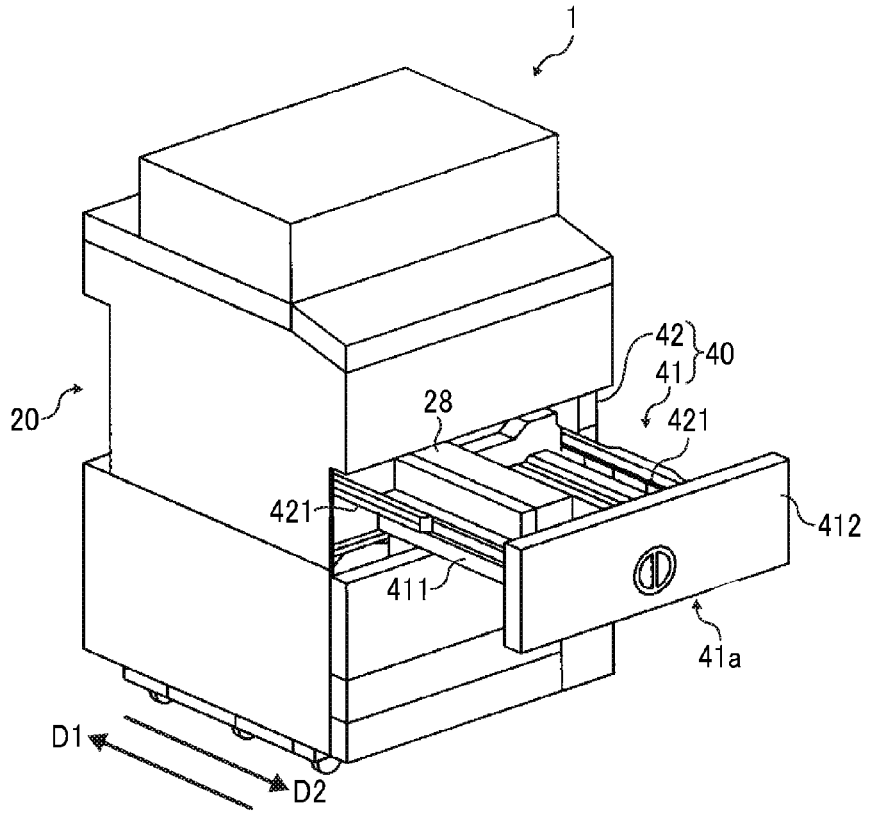
FIG. 2 is a perspective view illustrating a drawer unit of the image forming apparatus illustrated in FIG. 1.
Figure 3:
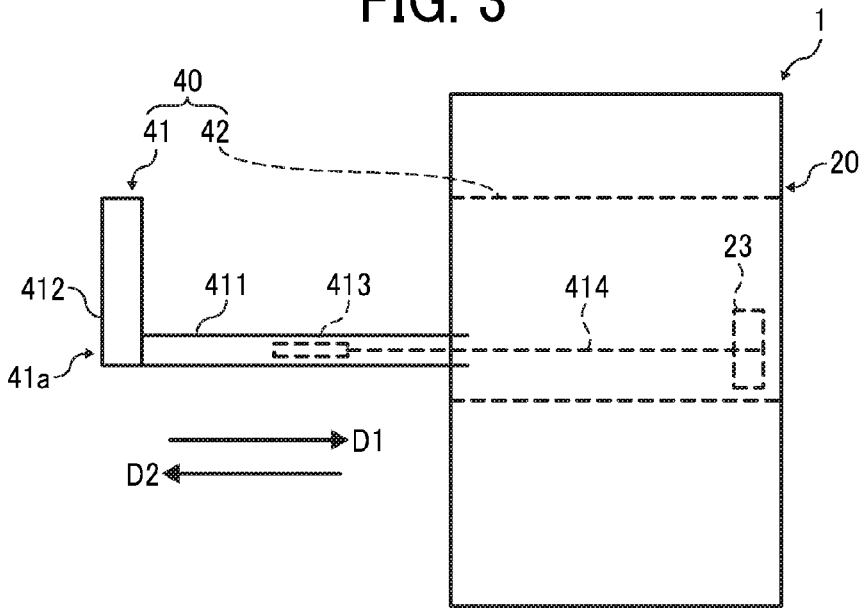
FIG. 3 is a side view of the drawer unit illustrated in FIG. 2.
Figure 4:
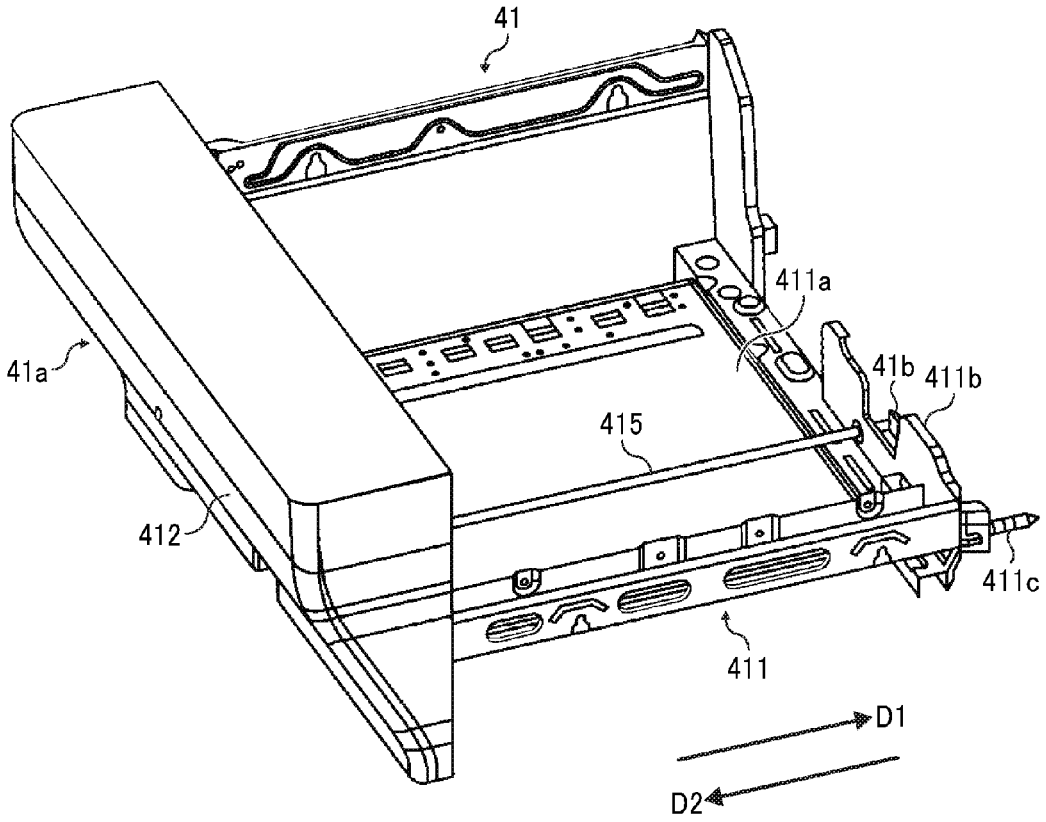
FIG. 4 is a perspective view illustrating in detail the drawer illustrated in FIGS. 2 and 3.

FIG. 2 is a schematic perspective view illustrating the drawer unit of the image forming apparatus illustrated in FIG. 1. FIG. 3 is a schematic side view illustrating the drawer unit. FIG. 4 is a perspective view illustrating in detail the drawer of the drawer unit illustrated in FIGS. 2 and 3. In order to simplify the figures, constituent parts of the drawer 41 other than the fixing device 28 are not illustrated in FIG. 2, and none of the constituent parts is illustrated in FIG. 3.

Referring to FIGS. 2, 3 and 4, the drawer 41 of the drawer unit 40 is inserted into the housing 42 in an inserting direction D1 of from the front side (i.e., user's side) to the inner side of the image forming apparatus, and is drawn from the housing 42 in a drawing direction D2 opposite to the inserting direction D1. The drawer 41 includes a main body 41*a* thereof including a carrier 411 to hold the constituent parts such as the fixing device 28, and a front cover 412 arranged on the front side of the carrier 411. The drawer main body 41*a* is supported by a rail 421, which is mounted on the housing 42, in such a manner as to be movable in the directions D1 and D2.

As illustrated in FIG. 3, a drawer's-side controller 413 (drive controller) is mounted on the carrier 411 of the drawer main body 41*a*. The drawer's-side controller 413 is electrically connected with the controller 23 and a power source of the image forming apparatus 1 via a cable 414. The drawer's-side controller 413 controls the operations of the constituent parts such as the fixing device 28, which are mounted on the carrier 411, under control of the controller 23 of the image forming apparatus 1. In this regard, the cable 414 is wound like a coil so that the cable is extended in the drawing direction D2 while shortened in the inserting direction D1. Therefore, when the drawer 41 is inserted or drawn, the cable 414 is shortened or extended.

As illustrated in FIG. 4, the carrier 411 of the drawer main body 41*a* includes a bottom plate 411*a*, and a rear plate 411*b*, which extends vertically from the rear edge of the bottom plate 411*a* so as to face the front cover 412. A positioning pin 411*c* projects in the inserting direction D1 from the rear plate 411*b*.

The drawer 41 further includes a rotating shaft 415, which extends from the front cover 412 to the rear plate 411*b* in the inserting direction D1. The rear end portion of the rotating shaft 415 passes through the rear plate 411*b* and projects from the rear plate, and a locking member 41*b* is mounted on the rear end portion of the rotating shaft. When the drawer 41 is inserted into the housing 42, the locking member 41*b* is engaged with a structure of the housing 42, which is described later, thereby locking the drawer so that the drawer is not drawn casually from the housing 42.

Figure 5A:
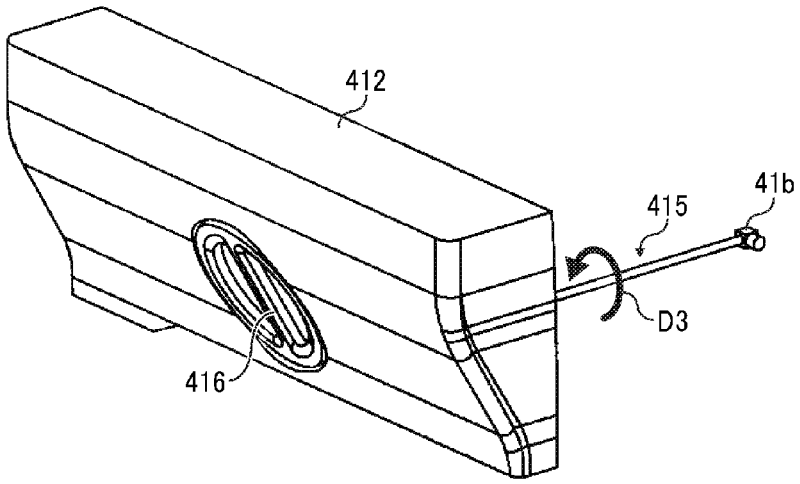
FIGS. 5A and 5B are schematic views illustrating a front cover, a rotating shaft, and a locking member of the drawer illustrated in FIG. 4.
Figure 5B:
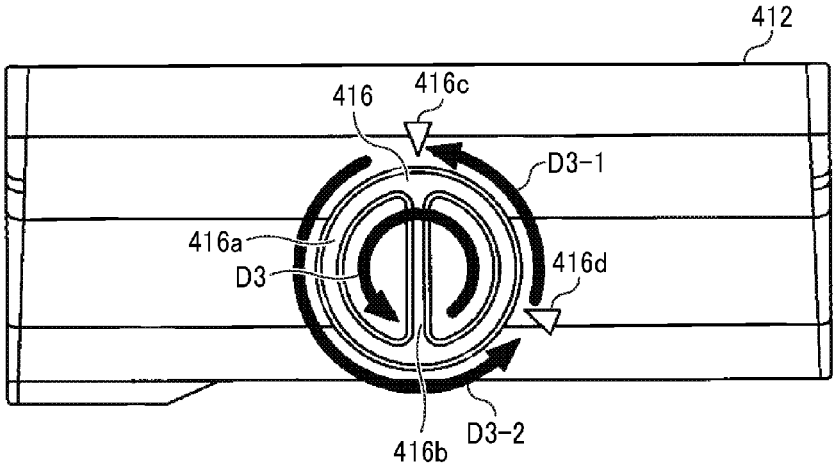

FIGS. 5A and 5B illustrate the front cover, the rotating shaft, and the locking member illustrated in FIG. 4. FIG. 5A is a perspective view, and FIG. 5B is a plan view when the front cover 412 is observed from the front side.

Referring to FIGS. 5A and 5B, an operating handle 416, by which the drawer 41 is locked or by which the drawer is unlocked prior to drawing of the drawer 41, is mounted on the front cover 412. The operating handle 416 includes a ring-shaped frame 416*a*, and a gripper 416*b* located inside the frame 416*a* while extending in the diameter direction of the frame. The operating handle 416 is rotatable in an operating direction D3 (i.e., counterclockwise) when the operating handle is observed from the front side. The operating handle 416 is connected with the front end of the rotating shaft 415, on the rear end of which the locking member 41*b* is mounted. Therefore, when the operating handle 416 is rotated in the operating direction D3, the rotating shaft 415 and the locking member 41*b* are also rotated in the direction D3.

A lock mark 416*c* representing a locked state of the locking member and an unlock mark 416*d* representing an unlocked state of the locking member are made on the front cover 412. When the operating handle 416 is operated so that the gripper 416*b* faces the lock mark 416*c*, the locking member 41*b* is engaged with the structure on the side of the housing 42, and thereby the drawer 41 is locked. In contrast, when the operating handle 416 is operated so that the gripper 416*b* faces the unlock mark 416*d*, the locking member 41*b* is released from the structure on the side of the housing 42 (i.e., the locking member is unlocked), and thereby the drawer 41 is unlocked.

In this regard, the operating handle 416 can be rotated only in the operating direction D3. Namely, when the drawer 41 is locked, the operating handle 416 is rotated so that the gripper 416*b* moves from the unlock mark 416*d* to the lock mark 416*c* in a locking direction D3-1. In this case, the locking member 41*b* is rotated from the unlock position to the lock position in the locking direction D3-1. In addition, when the drawer 41 is unlocked, the operating handle 416 is rotated so that the gripper 416*b* moves from the lock mark 416*c* to the unlock mark 416*d* in an unlocking direction D3-2. In this case, the locking member 41*b* is rotated from the lock position to the unlock position in the unlocking direction D3-2.

In the unlocked state in which the gripper 416*b* faces the unlock mark 416*d*, inserting and drawing of the drawer 41 are performed. After the drawer 41 is inserted, the operating handle 416 is rotated so that the gripper 416*b* faces the lock mark 416*c* (i.e., the locked state). The operating handle 416 can also be used as a grip for use in inserting or drawing the drawer 41.

Figure 6A:
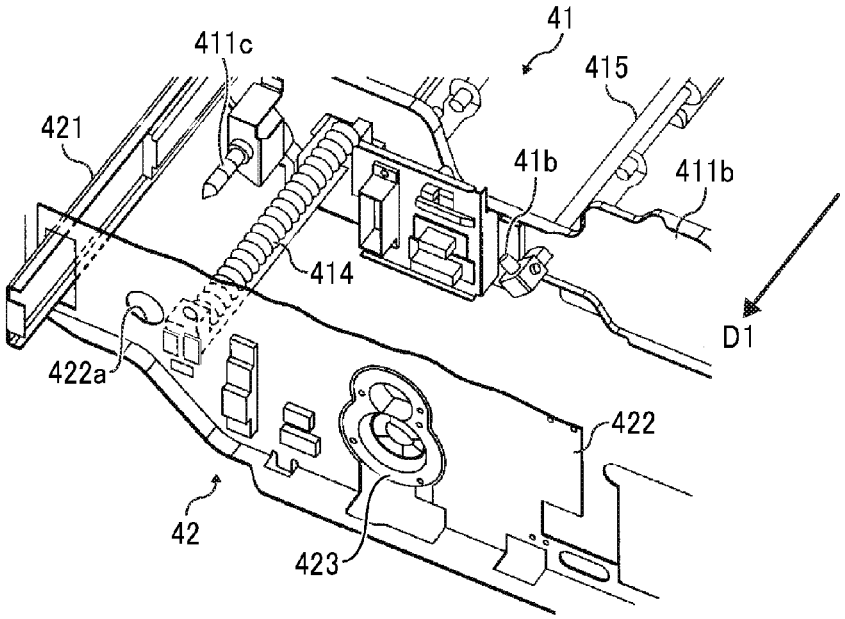
FIGS. 6A and 6B are schematic views illustrating the rear side of the drawer and the rear side of a housing facing the rear side of the drawer.
Figure 6B:
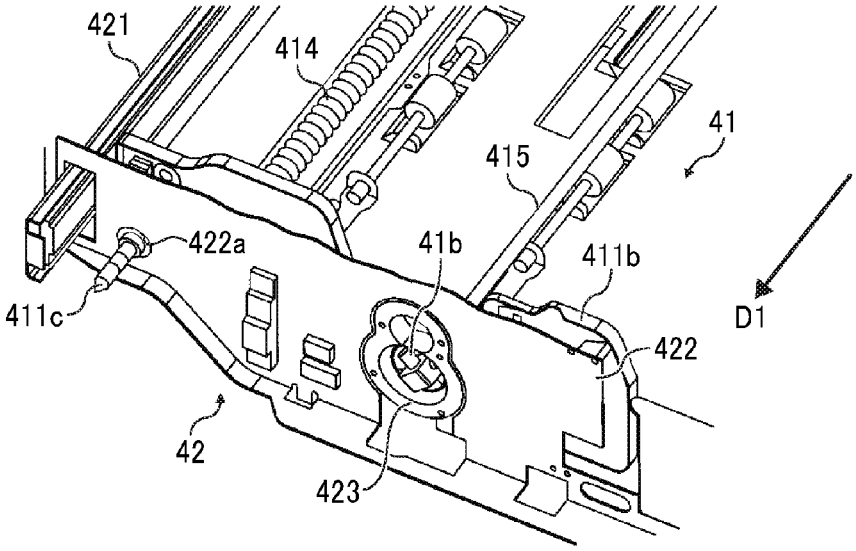

FIGS. 6A and 6B are perspective views illustrating the rear side of the drawer and the structure of the housing, which faces the rear side of the drawer. Specifically, FIG. 6A illustrates the rear side of the drawer 41 and the structure of the housing 42 when the drawer is drawn from the housing, and FIG. 6B illustrates the rear side of the drawer 41 and the structure of the housing 42 when the drawer is inserted into the housing.

As mentioned above, the cable 414 extending from the drawer's-side controller 413 is wounded like a coil, and therefore the cable is extended when the drawer 41 is drawn from the housing 42 while shortened when the drawer is inserted into the housing. In addition, the positioning pin 411*c* projects from the rear plate 411*b*. The housing 42 has a positioning opening 422*a* on a facing plate 422 thereof facing the rear plate 411*b*. When the drawer 41 is inserted in the inserting direction D1 while supported by the rail 421, the positioning pin 411*c* is inserted into the positioning opening 422*a* of the housing 42, and thereby the drawer 41 is positioned in the housing 42.

In this regard, the locking member 41*b* is mounted on the rear end of the rotating shaft 415, which projects from the rear plate 411*b* of the drawer 41, and extends in a direction intersecting the inserting direction D1. In addition, the facing plate 422 of the housing 42 has a lock receiver 423 which is engaged with the locking member 41*b* when the operating handle 416 is operated so that the locking member achieves the locked state. Hereinafter, the locking member 41*b* and the lock receiver 423 will be described in detail.

Figure 7:
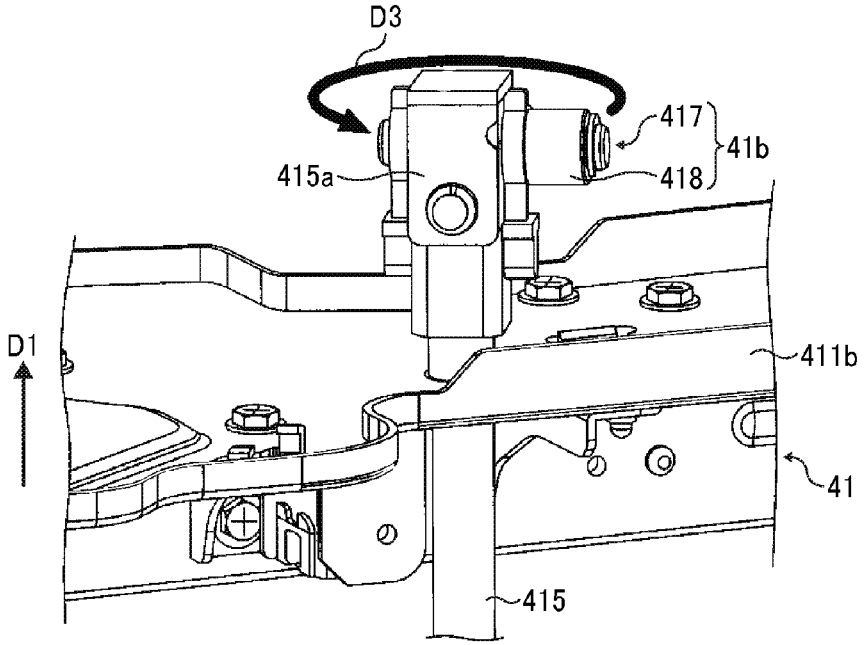
FIG. 7 is an enlarged view illustrating the locking member and the vicinity thereof.

FIG. 7 is an enlarged perspective view illustrating the locking member and a structure in the vicinity of the locking member. A prismatic engaging member 415*a* is mounted on the rear end of the rotating shaft 415, which rear end projects from the rear plate 411*b* of the drawer 41. The locking member 41*b* projects from the engaging member 415*a* in the direction intersecting the inserting direction D1. The locking member 41*b* includes a roller shaft 417 which extends in the direction intersecting the inserting direction D1, and a roller 418 rotatably mounted on the roller shaft 417. As mentioned above, the locking member 41*b* rotates on the rotating shaft 415 in the direction D3.

Figure 8:
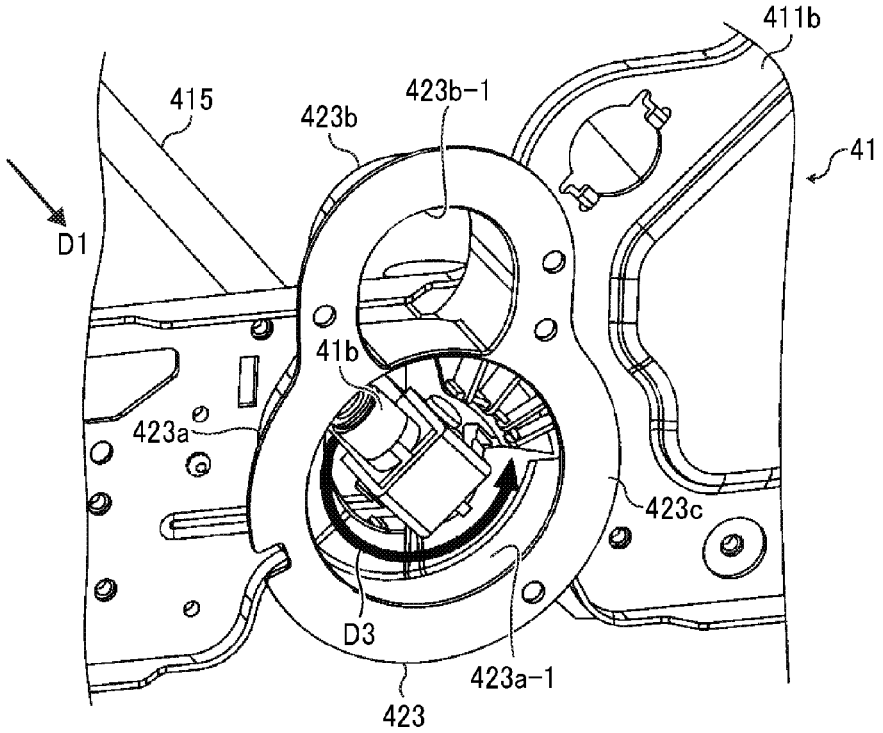
FIG. 8 is a schematic view illustrating a lock receiver mounted on a housing.

FIG. 8 is a schematic view illustrating the lock receiver mounted on the housing. In FIG. 8, only the lock receiver 423 is illustrated, and other parts of the housing 42 such as the facing plate 422 are not illustrated.

The lock receiver 423 has a shape like a figure "8", and includes two cylinders 423*a* and 423*b*, which are connected with each other so as to extend in the vertical direction. The lock receiver 423 further includes a flange 423*c*, which is mounted on the rear ends of the cylinders 423*a* and 423*b* to fix the cylinders to the facing plate 422. The lower cylinder 423*a* has a locking member entrance 423*a*-1, into which the locking member 41*b* enters together with the prismatic engaging member 415*a* when the drawer 41 is inserted into the housing 42. In this regard, in this drawer unit the secondary transfer device 27 (illustrated in FIG. 1) is located above the rotating shaft 415. The secondary transfer device 27 is a cylindrical member, and one end of the rotating shaft of the secondary transfer device projects from the rear plate 411*b*. Therefore, the upper cylinder 423*b* has an opening 423*b*-1 into which the end of the rotating shaft of the secondary transfer device 27 enters when the drawer 41 is inserted into the housing 42. The lock receiver 423 has a structure mounted on the locking member entrance 423*a*-1, wherein the structure is to be engaged with the locking member 41*b*.

In FIG. 8, the operating handle 416 is in the unlocked state because the drawer 41 is just inserted into the housing 42. Therefore, the locking member 41*b* has the unlock position. When the operating handle 416 is rotated in the operating direction D3 as illustrated in FIG. 5B, the locking member 41*b* is also rotated in the direction D3 as illustrate in FIGS. 7 and 8.

Figure 9:
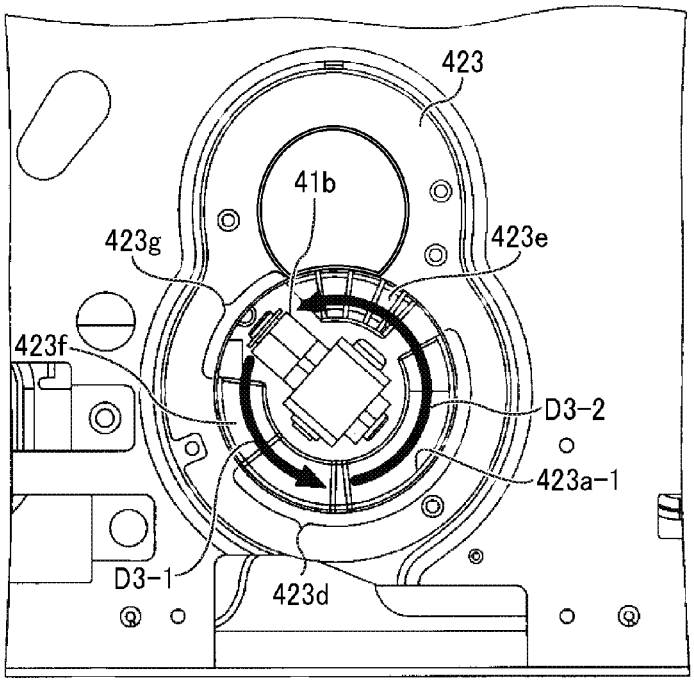
FIG. 9 is a plan view illustrating the rear side of the lock receiver, which receives the locking member entering into an entrance of the lock receiver.

FIG. 9 is a plan view illustrating the lock receiver, whose locking member entrance receives the locking member, from the rear side of the lock receiver. In FIG. 9, the locking member 41*b* has the unlock position.

The locking member entrance 423*a*-1 has a locking wall 423*d*, with which the locking member 41*b* is to be engaged when the drawer 41 is locked. In addition, the locking member entrance 423*a*-1 has a pushing wall 423*e*, which pushes the locking member 41*b* (and the drawer 41) while contacting the locking member when the locking member 41*b* is rotated in the unlocking direction D3-2. In addition, the locking member entrance 423*a*-1 includes a drawing wall 423*f*, which is located on an upstream side from the locking wall 423*d* relative to the locking direction D3-1 while located adjacent to the locking wall and which guides the locking member 41*b* to the locking wall 423*d* when the drawer 41 is locked, thereby drawing the drawer 41 together with the locking member 41*b*. There is a gap 423*g* between the pushing wall 423*e* and the drawing wall 423*f*.

Figure 10:
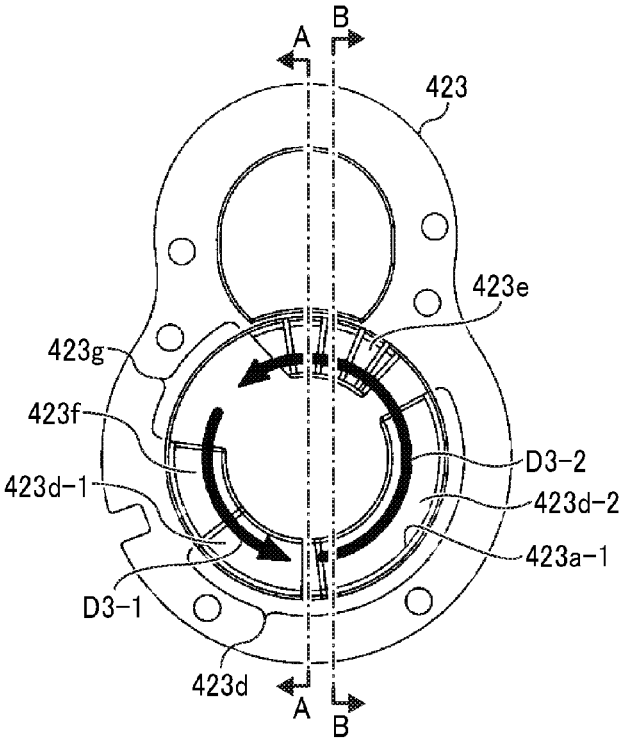
FIG. 10 is a plan view illustrating the lock receiver illustrated in FIG. 9.
Figure 11:
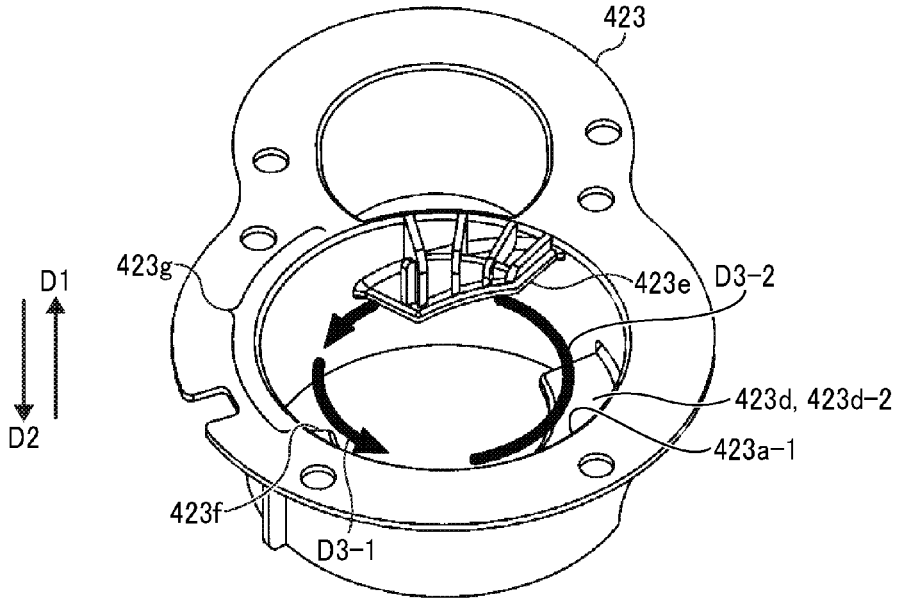
FIG. 11 is a perspective view illustrating the lock receiver from underneath.
Figure 12:
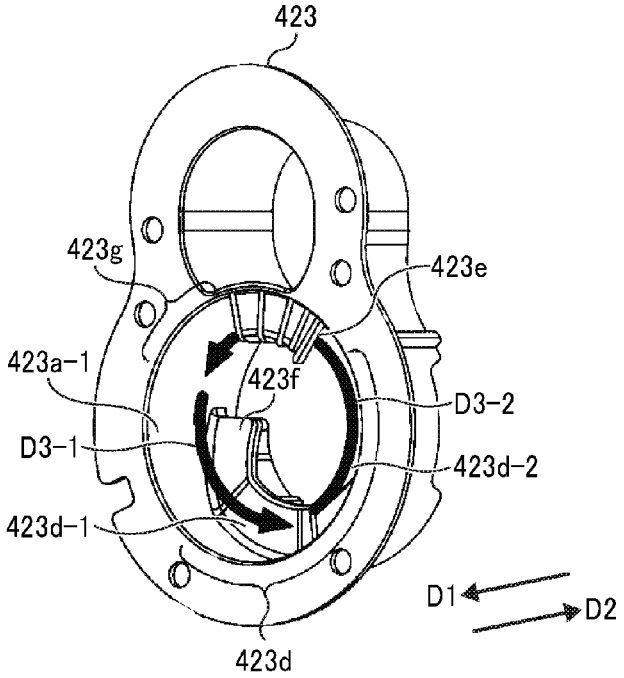
FIG. 12 is a perspective view illustrating the lock receiver from the right side.
Figure 14:
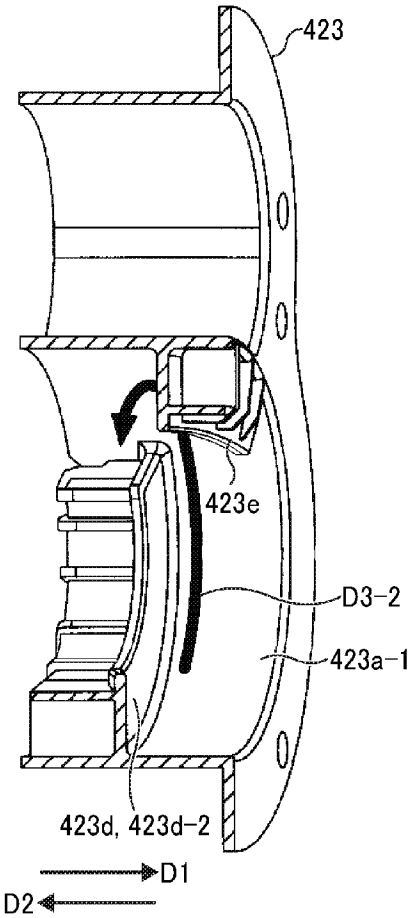
FIG. 14 is a perspective view illustrating the cross section of the lock receiver along a line B-B illustrated in FIG. 10.
Figure 13:
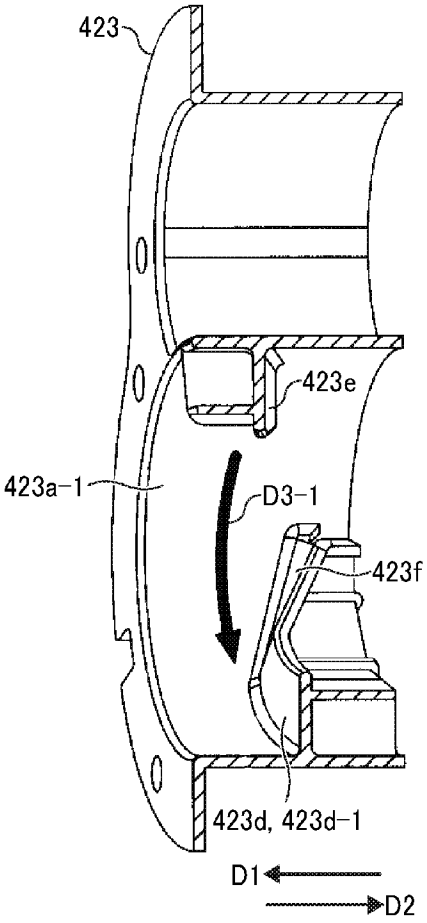
FIG. 13 is a perspective view illustrating the cross section of the lock receiver along a line A-A illustrated in FIG. 10.

FIG. 10 is a plan view illustrating the lock receiver, which is also illustrated in FIG. 9. FIG. 11 is a perspective view illustrating the lock receiver from underneath. FIG. 12 is a perspective view illustrating the lock receiver from the right side. FIG. 13 is a perspective view illustrating the cross section of the lock receiver along a line A-A illustrated in FIG. 10. FIG. 14 is a perspective view illustrating the cross section of the lock receiver along a line B-B illustrated in FIG. 10.

When the operating handle 416 (illustrated in FIGS. 5A and 5B) is rotated such that the gripper 416*b* faces the unlock mark 416*d*, the locking member 41*b* is positioned at the gap 423*g*. Namely, the gap 423*g* is the unlock position of the locking member 41*b*. In contrast, when the operating handle 416 is rotated such that the gripper 416*b* faces the lock mark 416*c*, the locking member 41*b* is positioned at a lock receiving portion 423*d*-1, which is part of the locking wall 423*d* and which is higher in the inserting direction D1 than the other portions of the locking wall 423*d*. The lock receiving portion 423*d*-1 is the lock position of the locking member 41*b*.

In order to insert the drawer 41, initially the gripper 416*b* of the operating handle 416 is positioned so as to face the unlock mark 416*d*, and the drawer 41 is inserted while the locking member 41*b* maintains the unlock position. In this case, the locking member 41*b* moves in the inserting direction D1 and enters into the locking member entrance 423*a*-1 of the lock receiver 423. In order to lock the drawer 41, the operating handle 416 is rotated in the locking direction D3-1 so that the gripper 416*b* faces the lock mark 416*c* and the locking member 41*b* is also rotated in the locking direction D3-1.

The lock receiving portion 423*d*-1 of the locking wall 423*d* is located in front of the locking member 41*b*, which has the lock position, relative to the drawing direction D2, and therefore the locking member 41*b* is engaged with the lock receiving portion 423*d*-1. In addition, the other portion of the locking wall 423*d* is a locking portion 423*d*-2, which is lower in level than the lock receiving portion 423*d*-1. In this regard, the locking portion 423*d*-2 is also located in front of the locking member 41*b* relative to the drawing direction D2. Therefore, even when the locking member 41*b* is released from the lock receiving portion 423*d*-1 and rotates in the unlocking direction D3-2, engagement of the locking member 41*b* is maintained (i.e., the locking member maintains the locked state) until the locking member is contacted with the pushing wall 423*e*.

In order to draw the drawer 41 in the drawing direction D2, initially the operating handle 416 is rotated such that the gripper 416*b* faces the unlock mark 416*d*, and thereby the locking member 41*b* is rotated in the unlocking direction D3-2 so that the locking member 41*b* has the unlock position.

The pushing wall 423*e* is located in front of the locking wall 423*d* relative to the inserting direction D1, and is a wall slanting in the drawing direction D2 relative to the unlocking direction D3-2. Therefore, when the locking member 41*b* is rotated in the unlocking direction D3-2, the locking member 41*b* is released from the locking portion 423*d*-2 of the locking wall 423*d*, and then contacts the pushing wall 423*e*. When the locking member 41*b* is further rotated in the unlocking direction D3-2, the locking member 41*b* is pushed in the drawing direction D2 by the slanting pushing wall 423*e*.

In this drawer unit, the drawing wall 423*f*, which is slanting in the inserting direction D1 relative to the locking direction D3-1, is located adjacent to the locking wall 423*d* while located on an upstream side from the locking wall relative to the locking direction D3-1. When the drawer 41 is inserted and then the operating handle 416 is rotated so that the gripper 416*b* faces the lock mark 416*c* and the locking member 41*b* is rotated from the unlock position to the lock position, the locking member 41*b* is initially contacted with the drawing wall 423*f*. The locking member 41*b* is guided to the lock receiving portion 423*d*-1, which is higher in level than the drawing wall 423*f*, along the slanting drawing wall, and thereby the locking member 41*b* is drawn in the inserting direction D1.

Figure 15:
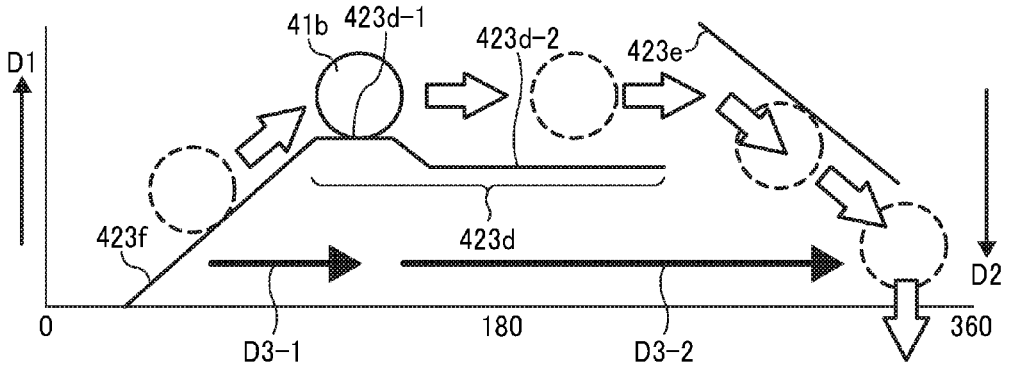
FIG. 15 is a schematic view illustrating how the locking member illustrated in FIG. 10 achieves a lock position from an unlock position, and achieves the unlock position from the lock position.

FIG. 15 is a schematic view illustrating how the locking member illustrated in FIG. 10 achieves the lock position from the unlock position to lock the drawer, and how the locking member achieves the unlock position from the lock position to unlock the drawer. In FIG. 15, the rotation angle (in units of degree) of the lock member 41*b* is plotted on the horizontal axis, wherein the rotation angle is 0° at the unlock position, and the position of the locking member 41*b* relative to the inserting direction D1 is plotted on the vertical axis, wherein the locking member located at an anterior position in the inserting direction D1 is plotted on an upper position of the vertical axis, and the locking member located at an anterior position in the drawing direction D2 is plotted on a lower position of the vertical axis.

When the locking member 41*b* is rotated from the unlock position to the lock position in the locking direction D3-1, the locking member 41*b* is guided to the lock receiving portion 423*d*-1, which is higher in level than the drawing wall 423*f*, along the slanting drawing wall. In this case, the locking member 41*b* is drawn in the inserting direction D1. When the locking member 41*b* is rotated from the lock position to the unlock position in the unlocking direction D3-2, the locking member 41*b* is contacted with the pushing wall 423*e* after passing the locking portion 423*d*-2, which is lower in level than the lock receiving portion 423*d*-1, while contacting the locking portion. When the locking member 41*b* is further rotated in the unlocking direction D3-2, the locking member 41*b* is pushed in the direction D2 by the pushing wall 423*e*.

When the locking member 41*b* is pushed in the drawing direction D2 by the pushing wall 423*e*, the drawer 41 is pushed in the drawing direction D2 together with the locking member 41*b*. Thus, by operating the operating handle 416*a* to rotate the locking member 41*b* in the unlocking direction D3-2 to unlock the drawer prior to drawing of the drawer 41, the drawer 41 is pushed in the drawing direction D2 together with the locking member 41*b*.

When the drawer 41 is inserted into the housing 42 and is locked, the positioning pin 411*c* is inserted into the positioning opening 422*a*. Although detail description is omitted in this disclosure, the drawer 41 is electrically connected with parts on the side of the housing 42 using a connector (connector connection) as well as the cable 414 mentioned above. When the drawer 41 is inserted into the housing 42 and is locked, such a connector achieves an engaging state. Therefore, in the early stage of the operation of drawing the drawer 41, the operation has to be performed while encountering the resistance forces such as forces needed for extraction of the positioning pin 411*c* from the positioning hole 422*a*, and cancelling of the connector connection. In the drawer unit 40 of this embodiment, when the unlocking operation is performed prior to drawing of the drawer 41, the drawer 41 is pushed in the drawing direction D2. Therefore, the positioning pin 411*c* is extracted from the positioning hole 422*a* to some extent, and in addition cancelling of the connector connection is also performed to some extent. Therefore, the forces needed for extraction of the positioning pin and cancelling of the connector connection can be decreased in the early stage of the operation of drawing the drawer 41. Namely, the force needed for drawing the drawer 41 can be decreased.

In this drawer unit, the drawing wall 423*f* is located on an upstream side relative to the locking direction D3-1 while being adjacent to the locking wall 423*d*. When the locking member 41*b* is rotated in the locking direction D3-1 in the locking operation performed after the drawer 41 is inserted, the locking member is contacted with the drawing wall 423*f*. When the locking member 41*b* is further rotated so as to move toward the lock position, the drawer 41 is drawn in the inserting direction D1. Even when the positioning pin 411*c* is insufficiently inserted into the positioning hole 422*a* or the connector connection is insufficiently performed, the drawer 41 is drawn in the inserting direction D1 by this locking operation, and thereby the positioning pin 411*c* is sufficiently inserted into the positioning hole 422*a* or the connector connection is sufficiently performed.

In addition, in this drawer unit, the locking member 41*b* is mounted on the drawer 41, and the pushing wall 423*e* is mounted on the housing 42, Since the inner space of the housing 42 is occupied by the drawer 41, the space has no room. Therefore, the locking member 41*b*, which has the rotating shaft 415 requiring a space, is mounted on the drawer 41, which has a relatively wide space compared to the housing 42, and the pushing wall 423*e*, which requires little space, is formed on the housing. Thus, the drawer unit 40 of this embodiment effectively uses the inner space thereof.

In addition, in this drawer unit, the locking wall 423*d* is located in front of the locking member 41*b*, which has the lock position, relative to the drawing direction D2. In addition, the pushing wall 423*e* is located in front of the locking wall 423*d* relative to the inserting direction D1 while slanting in the drawing direction D2 relative to the unlocking direction D3-2. Therefore, when the locking member 41*b* is rotated in the unlocking direction D3-2, the locking member 41*b* can smoothly move along the slanting pushing wall 423*e*, resulting in reduction of resistance of the locking member 41*b* to rotation in the unlocking direction D3-2.

Further, in this drawer unit, the drawing wall 423*f* is a wall, which is slanting in the inserting direction D1 relative to the locking direction D3-1 and which leads to the locking wall 423*d*. Therefore, when the locking member 41*b* is rotated in the locking direction D3-1, the locking member can smoothly move along the slanting drawing wall 423*f*, resulting in reduction of resistance of the locking member 41*b* to rotation in the locking direction D3-1.

Furthermore, in this drawer unit, the locking member 41*b* is equipped with the roller shaft 417 and the roller 418. Therefore, when the locking member 41*b* moves toward the locking wall 423*d* while contacting the drawing wall 423*f* in the locking operation, or when the locking member 41*b* moves toward the gap 423*g* while contacting the pushing wall 423*e* in the unlocking operation, contact resistance of the locking member 41*b* can be reduced when the locking member is contacted with the walls. As a result, the operating handle 416 can be smoothly operated in the locking operation and the unlocking operation.

Next, the second embodiment of this disclosure will be described. The second embodiment is similar to the first embodiment except for the structure of the lock receiver 423. Therefore, the second embodiment will be described while paying attention to the difference, and description of the common points (such as configuration of the image forming apparatus and the drawer unit) is omitted.

Figure 16:
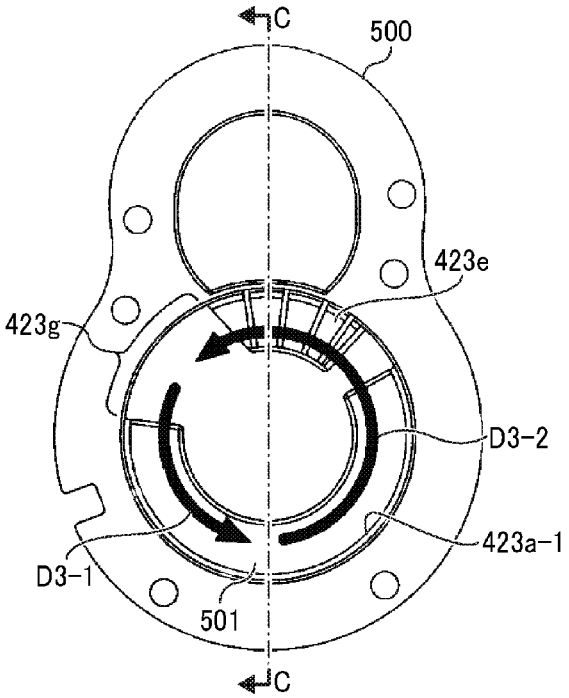
FIG. 16 is a plan view illustrating a lock receiver of a drawer unit according to a second embodiment of this disclosure.
Figure 18:
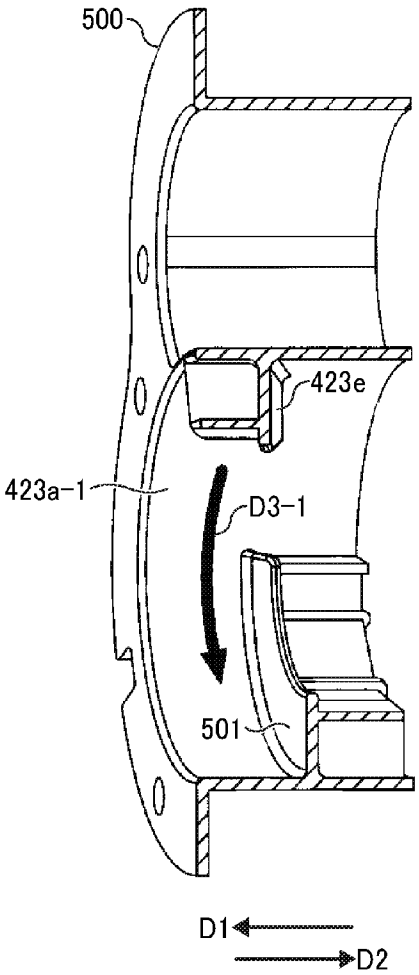
FIG. 18 is a perspective view illustrating the cross section of the lock receiver along a line C-C illustrated in FIG. 16.
Figure 17:
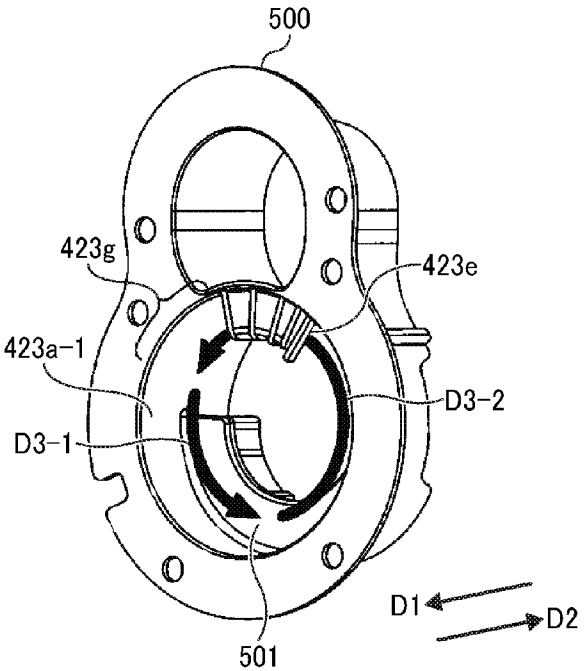
FIG. 17 is a perspective view illustrating the lock receiver illustrated in FIG. 16 from the right side.
Figure 19:
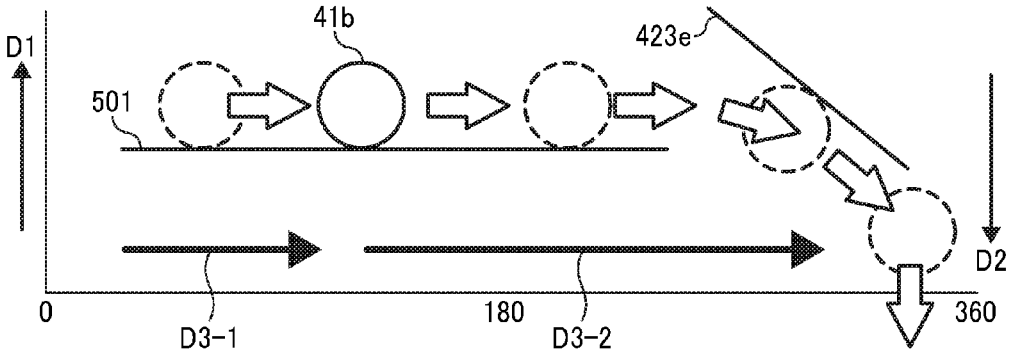
FIG. 19 is a schematic view illustrating how the locking member illustrated in FIG. 16 achieves a lock position from an unlock position, and achieves the unlock position from the lock position.

FIG. 16 is a plan view illustrating the lock receiver of the drawer unit of the second embodiment. FIG. 17 is a perspective view illustrating the lock receiver when the lock receiver is observed from the right side thereof. FIG. 18 is a perspective view illustrating the cross section of the lock receiver along a line C-C illustrated in FIG. 16. FIG. 19 is a schematic view illustrating how the locking member illustrated in FIG. 16 achieves the lock position from the unlock position to lock the drawer, and how the locking member achieves the unlock position from the lock position to unlock the drawer. In FIGS. 16-19, the constituent parts of the lock receiver and the arrows have the same reference numbers of the constituent parts of the lock receiver illustrated in FIGS. 10-15. Therefore, description of the constituent parts and the arrows will be omitted hereinafter. In addition, the second embodiment will be described by reference to the constituent parts illustrated in FIGS. 1-15, which are used for description of the first embodiment.

Referring to FIGS. 16-19, a lock receiver 500 of the drawer unit of the second embodiment does not have a slanting wall such as the drawing wall 423*f* of the lock receiver 423 of the drawer unit of the first embodiment. In addition, the lock receiver 500 includes a supporting wall 501, which is the unlock position and which is an ark-like flat wall extending from the gap 423*g* to a position just before the pushing wall 423*e* in the locking direction D3-1 and the unlocking direction D3-2.

When the drawer 41 is inserted in the inserting direction D1, the locking member 41*b* enters into the locking member entrance 423*a*-1. When the locking member 41*b* is rotated from the unlock position to the lock position in the locking direction D3-1, the locking member 41*b* initially runs upon the flat supporting wall 501, and then moves on the supporting wall until the gripper 416*b* faces the lock mark 416*c*. When the locking member 41*b* is rotated from the lock position to the unlock position in the unlocking direction D3-2, the locking member 41*b* is contacted with the pushing wall 423*e* after moving on the supporting wall 501. When the locking member 41*b* is further rotated in the unlocking direction D3-2, the locking member is pushed in the drawing direction D2 by the pushing wall 423*e*.

In the drawer unit of the second embodiment having the lock receiver 500, the locking member 41*b* runs upon the flat supporting wall 501 in the initial stage of the locking operation. Therefore, resistance that the locking operation encounters is relatively large compared to that in the first embodiment in which the locking member 41*b* moves along the slanting drawing wall 423*f*. However, even in this second embodiment, a force of drawing the drawer 41 in the inserting direction D1 is generated when the locking member 41*b* runs upon the flat supporting wall 501. Therefore, similarly to the first embodiment, by performing the locking operation after the drawer 41 is inserted, the positioning pin 411*c* can be perfectly inserted into the positioning hole 422*a* or the connector connection can be perfectly performed.

In addition, similarly to the first embodiment, the locking member 41*b* and the drawer 41 can be pushed by the pushing wall 423*e* in this second embodiment, and therefore the force needed for drawing the drawer 41 can be reduced.

Next, the third embodiment will be described. The difference between the third embodiment and the first embodiment is that the locking and unlocking operations are performed by motor driving in the third embodiment while the operating handle 416 is used therefor in the first embodiment. Since the structures of the image forming apparatus and the drawer unit are the same as those in the first embodiment, the third embodiment will be described while paying attention to the difference, and description of the common points is omitted.

Figure 20:
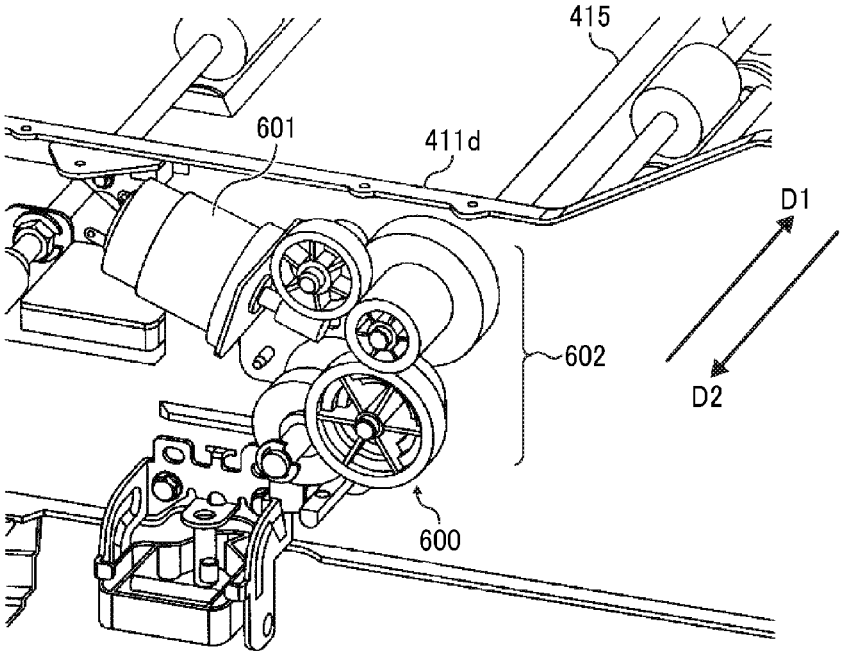
FIG. 20 is a schematic view illustrating a drawer unit according to a third embodiment of this disclosure, in which locking and unlocking are performed by motor driving.

FIG. 20 is a schematic view illustrating part of the drawer of the third embodiment, in which locking and unlocking are performed by motor driving. In FIG. 20, the constituent parts similar to the constituent parts used for the first embodiment have the same reference numbers of the constituent parts used for the first embodiment. Therefore, description of the constituent parts will be omitted hereinafter. The same is true for description of the third embodiment by reference to FIGS. 21 and 22. In addition, the third embodiment will be described by reference to the constituent parts illustrated in FIGS. 1-15, which are used for description of the first embodiment.

As illustrated in FIG. 20, a drive member 600 to drive the rotating shaft 415 of the locking member 41*b* is arranged between the front cover 412 of the drawer 41 and the front plate 411*d* of the carrier 411 (illustrated in FIG. 5). The drive member 600 includes a motor 601, and a group of gears 602 to transmit the rotary drive force of the motor to the rotating shaft 415.

In this third embodiment, the operation of the drive member 600 is controlled as mentioned below by the drawer's-side controller 413 (illustrated in FIG. 3). Specifically, the drawer's-side controller 413 controls in such a manner that when the drawer 41 is inserted, the drive member 600 rotates the locking member 41*b* from the unlock position to the lock position. In addition, the drawer's-side controller 413 controls in such a manner that when the drawer 41 is drawn, the drive member 600 rotates the locking member 41*b* from the lock position to the unlock position prior to drawing of the drawer 41. Thus, the drawer's-side controller 413 serves as a drive controller.

In this regard, rotary drive of the locking member 41*b* from the unlock position to the lock position performed when the drawer 41 is inserted is started under control of the drawer's-side controller 413, wherein the trigger of starting rotary drive is detection of insertion of the drawer 41 using such a sensor as mentioned below.

Figure 21:
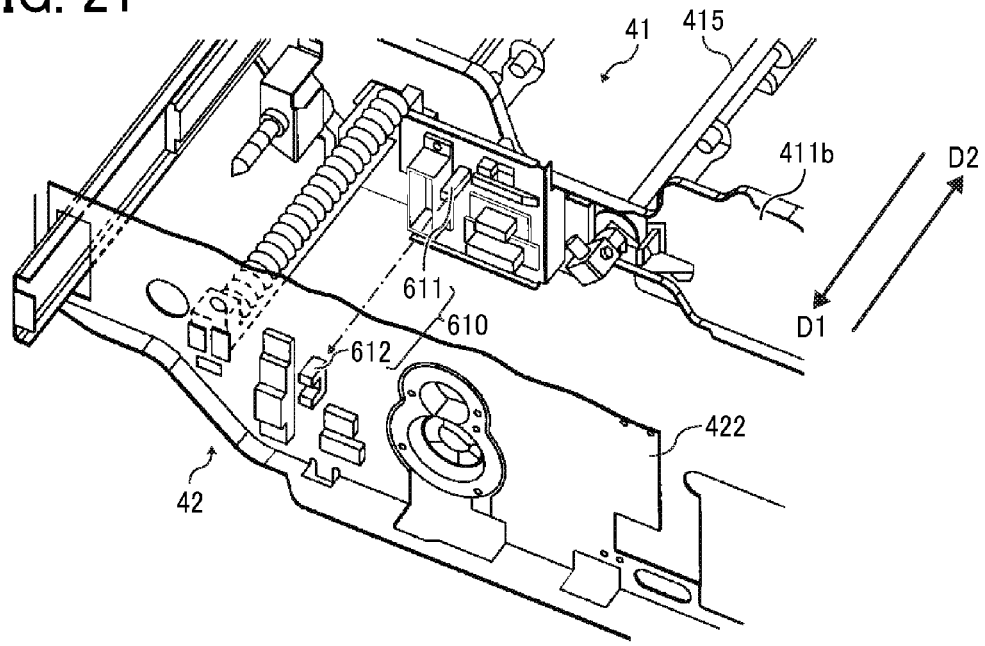
FIG. 21 is a schematic view illustrating a set sensor to detect insertion of the drawer.

FIG. 21 illustrates a sensor to detect insertion of the drawer. Specifically, a set sensor 610 to detect insertion of the drawer 41 include an inserting fin 611, and a photosensor 612 mounted on the facing plate 422 of the housing 42. The photosensor 612 has a configuration such that a light emitting element and a light receiving element are arranged in the vertical direction while having a space therebetween. When the drawer 41 is not inserted, light emitted by the light emitting element is detected by the light receiving element, and therefore the photosensor 612 is in an ON state. In contrast, when the drawer 41 is inserted, the inserting fin 611 is inserted into the space between the light emitting element and the light receiving element of the photosensor 612 after passing through a through-hole on the facing plate 422 of the housing 42. In this case, the inserting fin 611 intercepts light emitted by the light emitting element, and therefore the photosensor 612 achieves an OFF state. Thus, the set sensor 610 detects insertion of the drawer 41 when the photosensor 612 achieves the OFF state.

When insertion of the drawer 41 is detected by the set sensor 610, the drawer's-side controller 413 controls the drive member 600 such that the rotating shaft 415 (i.e., the locking member 41*b*) starts to rotate in the locking direction D3-1.

In contrast, when the drawer 41 is drawn, the drawer's-side controller 413 controls the drive member 600 such that the rotating shaft 415 (i.e., the locking member 41*b*) starts to rotate in the unlocking direction D3-2, wherein the trigger thereof is the following phenomenon. Specifically, in this embodiment, a release button (hereinafter unlock button) to perform unlocking is mounted on the front cover 412 of the drawer 41. In this regard, pushing the unlock button prior to drawing of the drawer 41 triggers the drawer's-side controller 413 to control the drive member 600 such that the rotating shaft 415 (i.e., the locking member 41*b*) starts to rotate in the unlocking direction D3-2.

In addition, the drawer unit of this embodiment includes a sensor to detect that the locking member 41*b* reaches the lock position from the unlock position and that the locking member reaches the unlock position from the lock position. The drawer's-side controller 413 controls the operation of the drive member 600 based on the detection results of the sensor. The sensor is the following.

Figure 22:
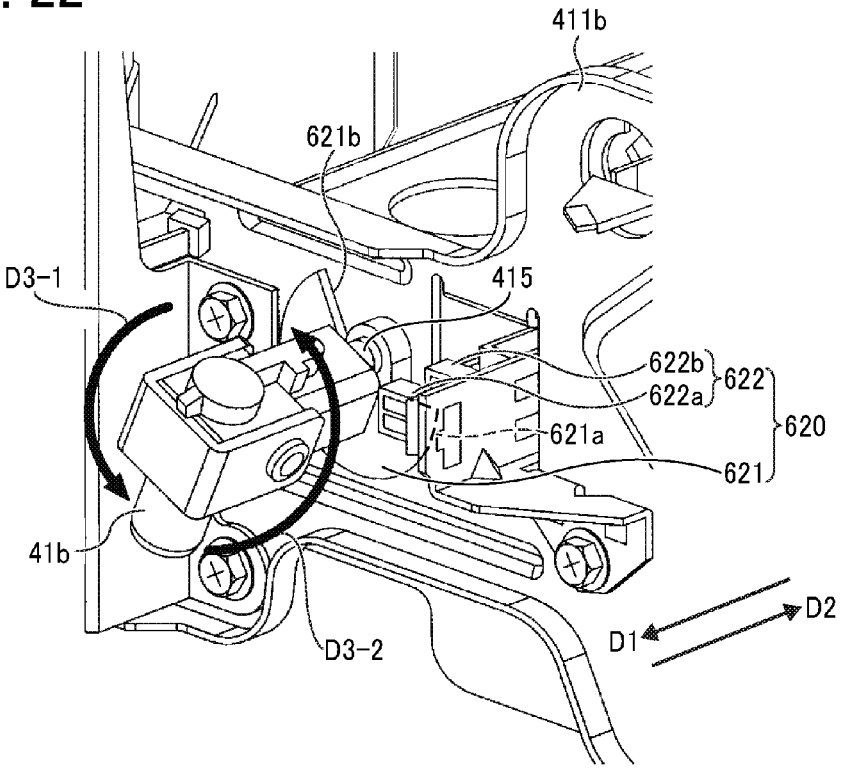
FIG. 22 is a schematic view illustrating a lock sensor to detect that the locking member achieves a lock position from the unlock position and that the locking member achieves the unlock position from the lock position.

FIG. 22 illustrates a lock sensor 620 to detect that the locking member 41*b* reaches the lock position from the unlock position and that the locking member reaches the unlock position from the lock position. The lock sensor 620 includes an inserting fin 621, which is mounted on the rotating shaft 415 and which is located on a downstream (rear) side from the rear plate 411*b* relative to the inserting direction D1. The inserting fin 621 is a disk, which is perpendicular to the rotating shaft 415 and which has a notch (i.e., part of the disk is cut). In addition, the lock sensor 620 includes a photosensor 622 which is mounted on the rear side of the rear plate 411*b*. The photosensor 622 has a configuration such that a light emitting element 622*a* and a light receiving element 622*b* are arranged in the inserting direction D1 while separated from each other. When the solid portion of the inserting fin 621 is located between the light emitting element 622*a* and the light receiving element 622*b* and the inserting fin intercepts light emitted by the light emitting element 622*a*, the photosensor 622 achieves an OFF state. When the notch of the inserting fin 621 is located between the light emitting element 622*a* and the light receiving element 622*b* and the inserting fin does not intercept light emitted by the light emitting element 622*a*, the photosensor 622 achieves an ON state.

The inserting fin 621 is set such that when the locking member 41*b* is rotated in the locking direction D3-1 and has the lock position, a first edge 621*a* of the notch of the inserting fin 621 reaches the space between the light emitting element 622*a* and the light receiving element 622*b*. Namely, during the locking member 41*b* is rotated in the locking direction D3-1, the photosensor 622 is in the ON state, and when the locking member 41*b* has the lock position, the photosensor 622 achieves the OFF state. Thus, the lock sensor 620 detects that the locking member 41*b* reaches the lock position from the unlock position when the photosensor 622 changes the state thereof from the ON state to the OFF state.

In addition, the inserting fin 621 is set such that when the locking member 41*b* is rotated in the unlocking direction D3-2 and has the unlock position, a second edge 621*b* of the notch of the inserting fin 621 reaches the space between the light emitting element 622*a* and the light receiving element 622*b*. Namely, during the locking member 41*b* is rotated in the unlocking direction D3-2, the photosensor 622 is in the OFF state, and when the locking member 41*b* has the unlock position, the photosensor 622 achieves the ON state. Thus, the lock sensor 620 detects that the locking member 41*b* reaches the unlock position from the lock position when the photosensor 622 changes the state thereof from the OFF state to the ON state.

As mentioned above, the drawer's-side controller 413 controls the drive member 600 to drive the locking member 41*b* to start rotating in the locking direction D3-1, wherein the trigger thereof is detection of insertion of the drawer 41. In addition, when the lock sensor 620 detects that the locking member 41*b* reaches the lock position, the drawer's-side controller 413 controls the drive member 600 to stop the rotary drive, resulting in completion of locking of the drawer 41.

In addition, the drawer's-side controller 413 controls the drive member 600 to drive the locking member 41*b* to start rotating in the unlocking direction D3-2, wherein the trigger thereof is push of unlock button. When the lock sensor 620 detects that the locking member 41*b* reaches the unlock position, the drawer's-side controller 413 controls the drive member 600 to stop the rotary drive, resulting in completion of unlocking of the drawer 41.

As mentioned above, the drawer unit of the third embodiment includes the drive member 600 to rotate the locking member 41*b*, and the drawer's-side controller 413 to control the drive member 600. Therefore, locking and unlocking can be automatically performed, and thereby burden on the user can be further reduced.

In addition, the drawer unit of the third embodiment includes the lock sensor 620 to detect that the locking member 41*b* reaches the lock position from the unlock position and that the locking member reaches the unlock position from the lock position. In this regard, the drawer's-side controller 413 controls the operation of the drive member 600 based on the detection results of the lock sensor 620. Specifically, the drawer's-side controller 413 controls the drive member 600 to stop rotary drive. Therefore, whether the locking member 41*b* reaches the lock position or the unlock position can be detected precisely, and therefore locking or unlocking of the drawer 41 can be secured.

In the image forming apparatus 1 illustrated in FIGS. 1 and 2, in which one or more of constituent parts are mounted on the drawer 41, when a recording medium sheet is jammed while bridging between the inside and the outside of the drawer 41, the recording medium sheet is deformed or broken if the sheet is drawn directly. When the recording medium sheet is broken, it is troublesome to remove the residue from the image forming apparatus.

According to the third embodiment, unlock of the drawer 41 is controlled by the drawer's-side controller 413. Therefore, when a recording medium sheet is jammed while bridging between the inside and the outside of the drawer 41, it becomes possible to control the drive member 600 not to perform rotary drive until the jammed recording medium sheet is removed or moved to the inside or outside of the drawer 41. By performing such a control, unlocking of the drawer 41 is not performed until the jammed recording medium sheet is removed or moved to the inside or outside of the drawer 41. Therefore, occurrence of the problem in that the jammed recording medium sheet is deformed or broken by drawing the drawer 41 can be prevented.

As described above by reference to FIG. 1, the sheet sensors 294 are arranged at several positions of the image forming apparatus 1. For example, when the jammed recording medium sheet is detected by the sheet sensor 294 located on the downstream side from the pickup roller 341 of the manual recording medium tray 35, the jammed recording medium sheet is deformed or broken if the drawer 41 is drawn. The same is true for the jammed recording medium sheet detected by the sheet sensor 294 located above the sheet feeding passage 34, and for the jammed recording medium sheet detected by the sheet sensor 294 located on the upstream side from the sheet ejecting roller 291. Since the control mentioned above is performed in this embodiment, occurrence of the problem in that the jammed recording medium sheet is deformed or broken by drawing the drawer 41 can be prevented.

Next, the fourth embodiment of this disclosure will be described. In this fourth embodiment, locking and unlocking of the drawer 41 are performed by motor drive similar to the third embodiment, but the locking and unlocking method is different from that in the third embodiment. The configuration of the image forming apparatus and the drawer unit of the fourth embodiment is the same as that of the third (or first) embodiment. Therefore, hereinafter the fourth embodiment will be described while paying attention to the difference between the fourth embodiment and the third embodiment, and description of the common points is omitted. In addition, the fourth embodiment will be described by reference to the constituent parts illustrated in FIGS. 1-22, which are used for the description of the first, second and third embodiments.

In the fourth embodiment, the rotation direction of the locking member 41*b* in the unlocking operation performed when the recording medium sheet is jammed is different from the rotation direction of the locking member in the unlocking operation performed in other cases.

Although description is omitted in the first to third embodiments, jamming of the recording medium sheet is detected by the following method in the image forming apparatus 1. Specifically, the sheet sensors 294 are arranged at several positions of the image forming apparatus 1. When the recording medium sheet is smoothly fed without jamming, the recording medium sheet passes the sheet sensors 294 at predetermined times. However, when the recording medium sheet is jammed, the sheet sensor 294 located on the downstream side from the jamming point does not detect the recording medium sheet at the predetermined time. In this case, the controller 23 recognizes (detects) jamming of the recording medium sheet, and notifies the drawer 41 of the jamming of the recording medium sheet.

In this fourth embodiment, the unlock button is mounted on the drawer 41 similarly to the third embodiment. In this fourth embodiment, when there is no notification of jamming before the unlock button is pushed, the button pushing operation triggers rotation of the locking member 41*b* for unlocking. In contrast, when there is a notification of jamming before the unlock button is pushed, rotation of the locking member 41*b* is automatically started under the below-mentioned control without performing the operation instructed by pushing the unlock button.

In this fourth embodiment, the rotation direction of the locking member 41*b* in the case in which there is a notification of jamming before the unlock button is pushed is different from the rotation direction of the locking member 41*b* in the case in which there is no notification of jamming before the unlock button is pushed. The difference will be described below.

Figure 23:
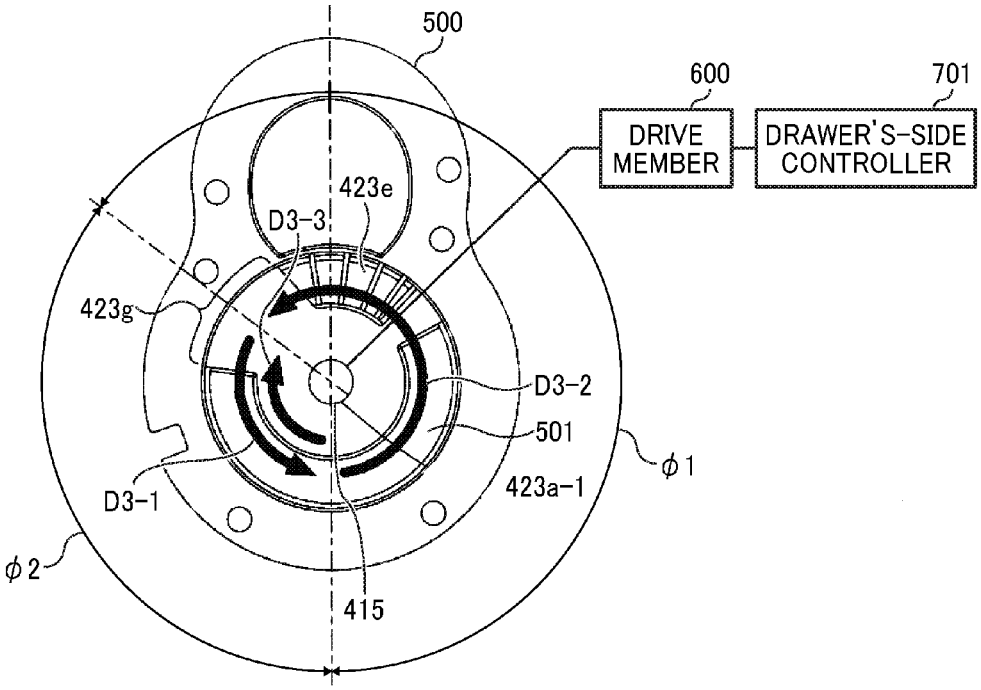
FIG. 23 is a schematic view illustrating a rotation direction of a locking member of a drawer unit according to a fourth embodiment of this disclosure when the locking member rotates to achieve the unlock position in a case of jamming of a recording medium sheet, and a rotation direction of the locking member rotating to achieve the unlock position in other cases.
Figure 24:
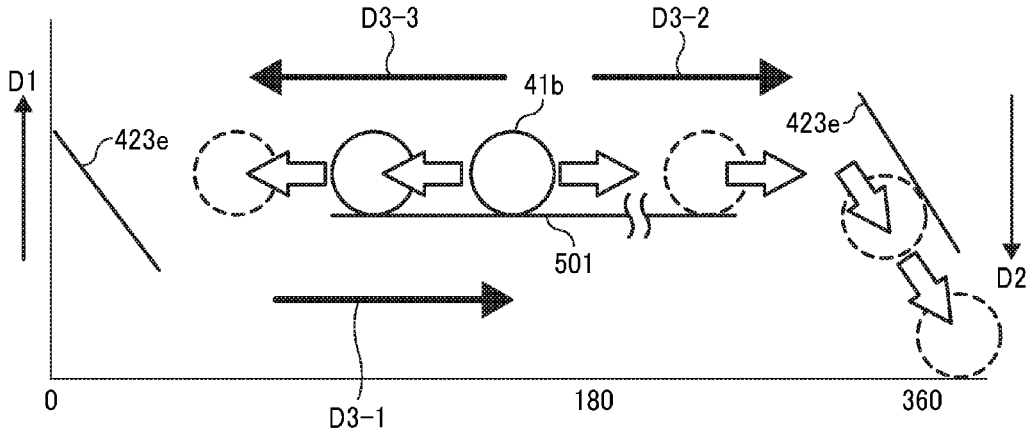
FIG. 24 is a schematic view illustrating how the locking member illustrated in FIG. 23 achieves the unlock position when rotating in the two rotation directions.

FIG. 23 is a schematic view illustrating a rotation direction of the locking member of the drawer unit according to the fourth embodiment of this disclosure, wherein the locking member rotates to achieve the unlock position in a case of jamming of the recording medium sheet, and a rotation direction of the locking member, wherein the locking member rotates to achieve the unlock position in other cases. FIG. 24 is a schematic view illustrating how the locking member illustrated in FIG. 23 achieves the unlock position when rotating in the two rotation directions. In FIGS. 23 and 24, the constituent parts and arrows have the same reference numbers of the constituent parts and arrows, which are used for the first to third embodiments and which are illustrated in FIGS. 1-22. Therefore, description of the constituent parts will be omitted hereinafter. The same is true for description of the fourth embodiment by reference to FIGS. 25-28.

As illustrated in FIGS. 23 and 24, the lock receiver 500 having the flat supporting wall 501, which is described above in the second embodiment by reference to FIGS. 16-19, is used for the fourth embodiment.

In this fourth embodiment, the rotating shaft 415 of the locking member 41*b* can also be rotated in a second unlocking direction D3-3, which is opposite to the locking direction D3-1 and the unlocking direction D3-2. In this regard, when the locking member 41*b* is rotated from the lock position on the supporting wall 501 to the unlock position (i.e., the gap 423*g*) via the pushing wall 423*e* in the unlocking direction D3-2, the locking member 41*b* is rotated at a first angle ϕ1. In contrast, when the locking member 41*b* is rotated from the lock position to the unlock position in the second unlocking direction D3-3, the locking member 41*b* is rotated at a second angle ϕ2, which is smaller than the first angle ϕ1.

In this regard, when jamming of the recording medium sheet occurs, the controller 23 of the image forming apparatus 1 notifies a drawer's-side controller 701 of detection of jamming. When the drawer's-side controller 701 receives the notification before the unlock button is pushed, the drawer's-side controller 701 controls the drive member 600 to drive the locking member 41*b* to rotate in the unlocking direction D3-2 so as to have the unlock position. In contrast, when the drawer's-side controller 701 does not receive the notification before the unlock button is pushed, the drawer's-side controller 701 controls the drive member 600 to drive the locking member to rotate in the second unlocking direction D3-3 so as to have the unlock position.

When jamming of the recording medium sheet occurs, it is highly possible that the drawer 41 is drawn to remove the jammed recording medium sheet. Therefore, in this embodiment, the locking member 41*b* is rotated in the unlocking direction D3-2, so that the locking member is pushed by the pushing wall 423*e* and thereby the drawer 41 is pushed in the unlocking direction D2.

In contrast, when the unlock button is pushed even though jamming of the recording medium sheet does not occur, it is possible that the drawer 41 is not drawn and is locked again. For example, when maintenance is performed or parts are replaced with new parts, it is possible that although the user pushes the unlock button, the user leaves the image forming apparatus 1 without making any action because the user thinks of another job to be performed quickly. In such a case, if the locking member 41*b* is pushed at a relatively long distance in the drawing direction D2, it is possible that the locking member cannot be locked by the rotation in the locking direction D3-1. In the case in which jamming of the recording medium sheet does not occur, it is possible that the drawer 41 is not drawn and is locked again, and the locking member cannot be locked again because the locking member is pushed at a relatively long distance, and therefore it is preferable not to push the drawer 41. In addition, since it is possible that the drawer 41 is rapidly locked again, it is preferable that the time needed for unlocking is as short as possible.

Therefore, in this embodiment, when jamming of the recording medium sheet does not occur, the locking member 41*b* is rotated in the second unlocking direction D3-3 without passing the pushing wall 423*e* to achieve the unlock position. In this case, since the second rotation angle ϕ2 in the second unlocking direction D3-3 is smaller than the first angle ϕ1 in the unlocking direction D3-2, the unlocking operation can be performed in a short time. In addition, since the drawer 41 is not pushed in the drawing direction D2, the position of the locking member 41*b* is not changed in the drawing direction D2. Therefore, when the drawer 41 is not drawn and is locked again, the locking member 41*b* can be smoothly moved to the supporting wall 501. Therefore, the locking operation can be performed again while reducing the burden on the locking member 41*b* and the drive member 600.

In addition, in this embodiment, when jamming of the recording medium sheet occurs, the unlocking operation is automatically performed under the below-mentioned control of the drawer's-side controller 701 without performing the operation using the unlock button.

When jamming of the recording medium sheet occurs in the image forming apparatus 1, the jamming is resolved by performing plural processes including a process of drawing the drawer 41. In addition, the plural processes include a process in which, when the recording medium sheet is jammed while bridging between the inside and the outside of the drawer 41, the recording medium sheet is moved to the inside or outside of the drawer prior to drawing of the drawer 41. Further, a process in which, when the recording medium sheet is jammed at a location other than the drawer 41, the jammed recording medium sheet is removed from the image forming apparatus 1 prior to drawing of the drawer 41 is also included in the plural processes.

In this embodiment, the plural processes mentioned above are performed under control of the controller 23 of the image forming apparatus 1. When the controller 23 decides that it is time to draw the drawer 41, the controller 23 notifies the drawer's-side controller 701 of the decision. The drawer's-side controller 413 controls the drive member 600 to drive the locking member 41*b* to start rotating, wherein the trigger thereof is the notification from the controller 23. In this regard, the locking member 41*b* is rotated in the unlocking direction D3-2 via the pushing wall 423, and therefore the drawer 41 is pushed in the drawing direction D2 along with unlocking, thereby reducing resistance of the drawer 41 to drawing. In addition, since the drawer 41 is pushed at this time, the user is notified that it is time to perform a process of drawing the drawer 41, followed by a process of removing the recording medium sheet from the drawer 41.

In this embodiment, a position sensor to detect two positions (mentioned below) of the drawer 41 in the inserting direction D1 and the drawing direction D2 is provided.

Figure 25:
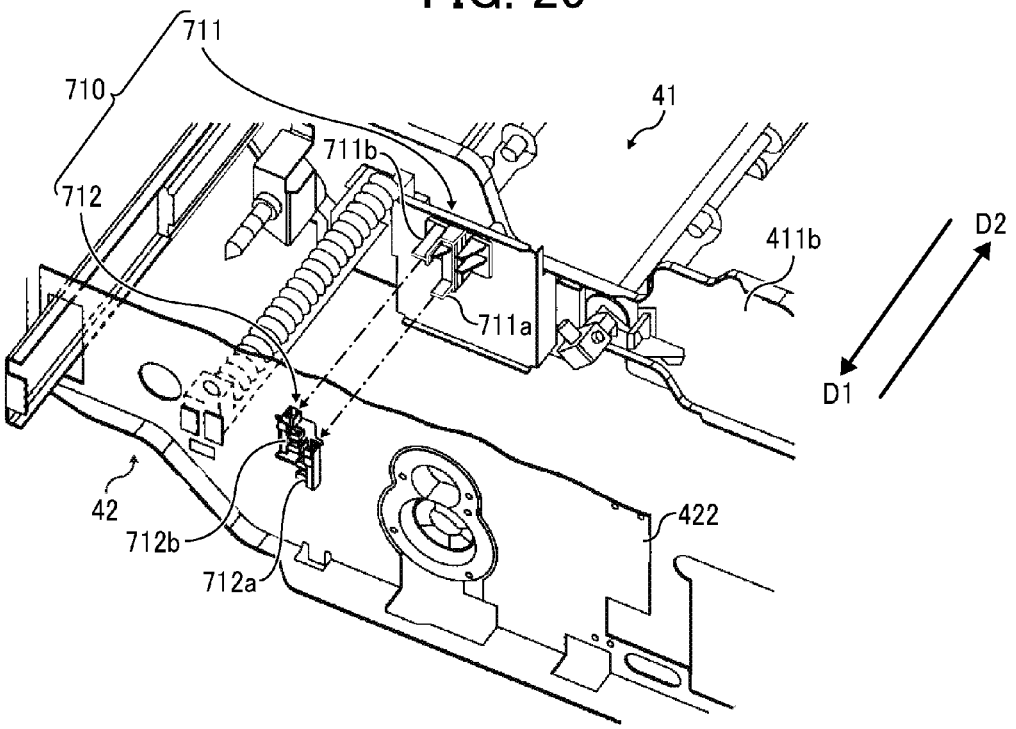
FIG. 25 is a schematic view illustrating a position sensor to detect the position of the drawer when the drawer is inserted in an inserting direction D1 or drawn in a drawing direction D2.

FIG. 25 is a schematic view illustrating a position sensor 710 to detect two positions of the drawer 41 in the inserting direction D1 and the drawing direction D2. The position sensor 710 includes an inserting fin unit 711, which projects from the rear plate 411*b* of the drawer 41 in the inserting direction D1, and a photosensor unit 712 mounted on the facing plate 422 of the housing 42.

The inserting fin unit 711 includes a first inserting fin 711*a* and a second inserting fin 711*b*, which are arranged so as to be apart from each other in the vertical direction. The first inserting fin 711*a* is located below the second inserting fin 711*b*.

The photosensor unit 712 includes a first photosensor 712*a* and a second photosensor 712*b*, which correspond to the first inserting fin 711*a* and the second inserting fin 711*b*, respectively. Each of the first and second photosensors 712*a* and 712*b* has a light emitting element and a light receiving element, which are arranged in the vertical direction while separated from each other. When the drawer 41 is not inserted, light emitted by the light emitting element is received by the light receiving element, and therefore the photosensor achieves the ON state. When the drawer 41 is inserted, the first inserting fin 711*a* and the second inserting fin 711*b* are respectively inserted into the gap between the light emitting element and the light receiving element of the first photosensor 712*a* and the gap between the light emitting element and the light receiving element of the second photosensor 712*b*. In this case, since the light receiving elements do not receive light emitted by the light emitting elements, each of the first and second photosensors 712*a* and 712*b* achieves the OFF state.

Figure 26:
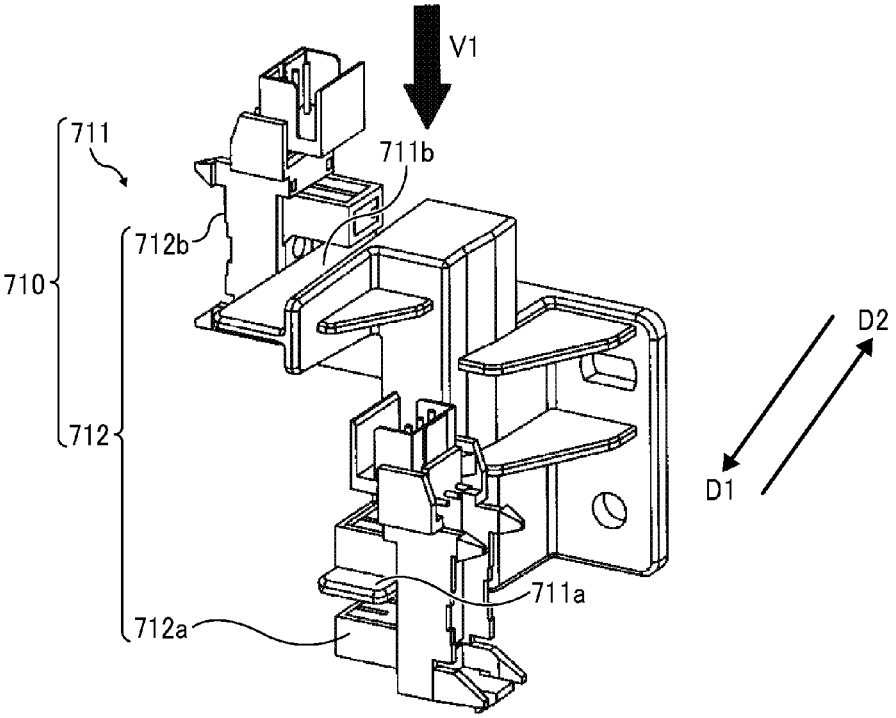
FIG. 26 is a perspective view illustrating the position sensor whose first and second insertion fins are inserted into corresponding gaps between a light emitting element and a light receiving element of first and second photosensors.
Figure 27:
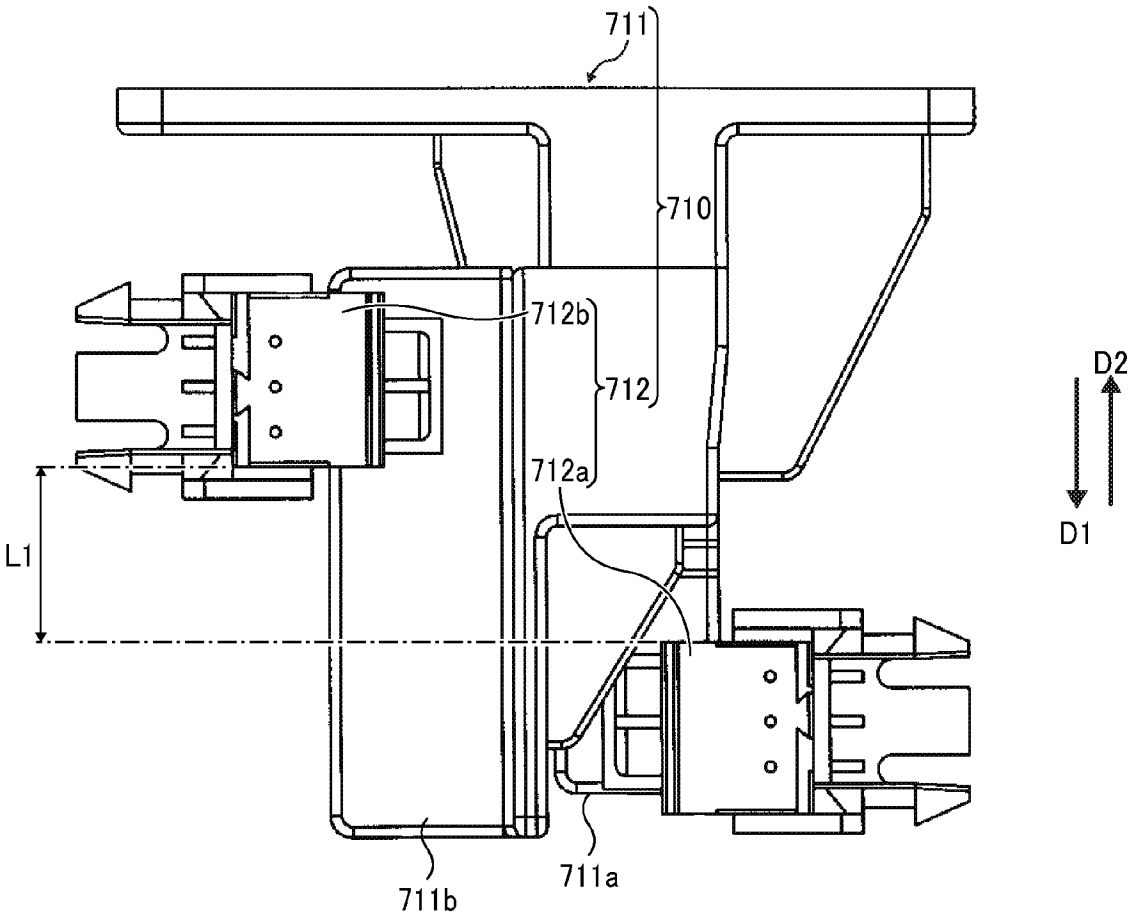
FIG. 27 is a plan view illustrating the position sensor illustrated in FIG. 26 from a direction indicated by an arrow V1 illustrated in FIG. 26.

FIG. 26 illustrates the position sensor in which the first inserting fin and the second inserting fin are respectively inserted into the gap between the light emitting element and the light receiving element of the first photosensor and the gap between the light emitting element and the light receiving element of the second photosensor. FIG. 27 is a plan view illustrating the position sensor illustrated in FIG. 26 from a direction V1 illustrated in FIG. 26.

As illustrated in FIG. 27, the first photosensor 712*a* and the second photosensor 712*b* are located at different positions in the inserting direction D1 and the drawing direction D2. Specifically, the first photosensor 712*a* is located in front of the second photosensor 712*b* in the inserting direction D1, and the second photosensor 712*b* is located in front of the first photosensor 712*a* in the drawing direction D2. In this regard, the distance between the first and second photosensors is L1 as illustrated in FIG. 27.

When the drawer 41 is inserted in the inserting direction D1 and the drawer reaches a distant position before the predetermined perfect insertion position at the distance L1 in the inserting direction D1, the photosensor 710 performs the following detection. Specifically, in this stage, the second inserting fin 711*b*, which is located on the upper side, is inserted into the gap between the light emitting element and the light receiving element of the second photosensor 712*b*, which is also located on the upper side. As a result, the second photosensor 712*b* achieves the OFF state, and the position sensor 710 detects that the drawer 41 reaches the distant position.

When the drawer 41 is further inserted and the drawer is completely inserted to the perfect insertion position, the first inserting fin 711*a*, which is located on the lower side, is inserted into the gap between the light emitting element and the light receiving element of the first photosensor 712*a*, which is also located on the lower side. As a result, the first photosensor 712*a* achieves the OFF state. In this case, the second photosensor 712*b* maintains the OFF state. When the first photosensor 712*a* achieves the OFF state, the position sensor 710 detects that the drawer 41 is completely inserted to the perfect insertion position.

When the drawer 41 is drawn in the drawing direction D2, initially the first inserting fin 711*a* is drawn from the gap between the light emitting element and the light receiving element of the first photosensor 712*a*, and thereby the first photosensor 712*a* achieves the ON state. When the drawer 41 is further drawn and the second inserting fin 711*b* passes through the gap between the light emitting element and the light receiving element of the second photosensor 712*b*, the second photosensor 712*b* achieves the ON state while the first photosensor 712*a* maintains the ON state. Thus, the position sensor 710 detects that the drawer 41 is drawn to the distant position when the second photosensor 712*b* achieves the ON state.

Thus, the first photosensor 712*a* serves as a first sensor which detects that the drawer 41 is located at the perfect insertion position, and the second photosensor 712*b* serves as a second sensor which detects that the drawer 41 is located at the distant position.

The drawer's-side controller 701 notifies the controller 23 of the image forming apparatus 1 of the detection results of the first and second photosensors 712*a* and 712*b*.

In this embodiment, when jamming of the recording medium sheet occurs in the image forming apparatus 1, a guide image is displayed in the operation panel of the image forming apparatus. The guide image includes guidance on the plural processes of resolving jamming of the recording medium sheet. Specifically, regarding the process of drawing the drawer 41 and the subsequent process of removing the jammed recording medium sheet, the following guide images are displayed.

Figure 28A:
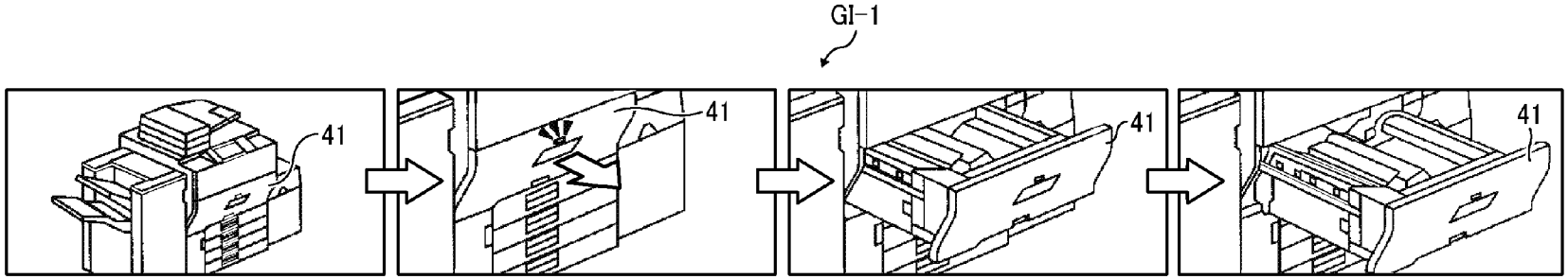
FIGS. 28A and 28B are images which are respectively used as an operation guide for drawing the drawer and another operation guide for removing a recoding medium sheet from the drawer.
Figure 28B:
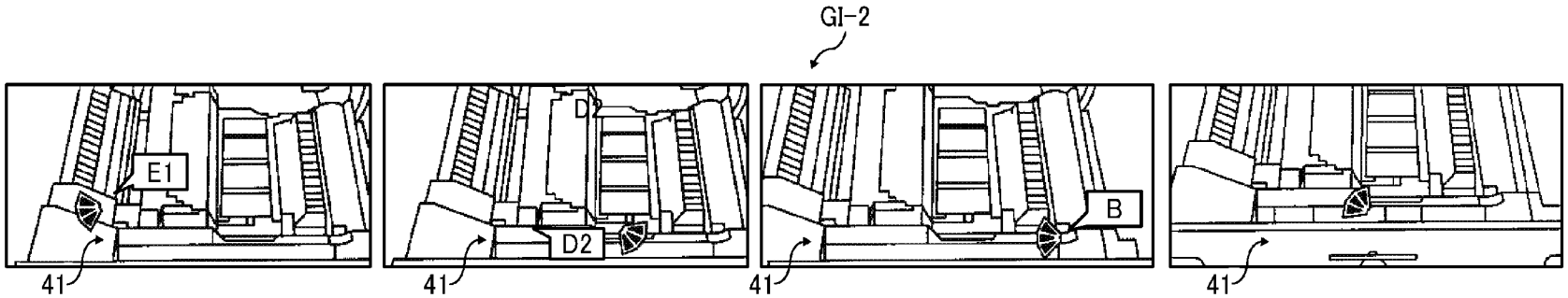

FIGS. 28A and 28B are guide images which are respectively used for the process of drawing the drawer and the subsequent process of removing the recoding medium sheet from the drawer. Specifically, FIG. 28A illustrates a guide image GI-1 for use in the process of drawing the drawer, and FIG. 28B illustrates another guide image GI-2 for use in the process of removing the recording medium sheet.

The guide image GI-1 illustrated in FIG. 28A is an animation image including four images which gradually change from left to right and which are used for illustrating the way to draw the drawer 41. The guide image GI-2 illustrated in FIG. 28B illustrates the sheet removing position, from which the recording medium sheet jammed in this time is removed, among plural sheet removing positions present in the drawer 41. In this regard, among the plural sheet removing positions, the sheet removing position to be used for this time is illustrated. In addition, when plural recording medium sheets are jammed in the drawer 41 and the recording medium sheets have to be removed from plural sheet removing positions, the guide image GI-2 changes in every removal of the recording medium sheet. Thus, the plural sheet removing positions are guided one by one.

When it is time to perform the process of drawing the drawer 41, initially the guide image GI-1 illustrated in FIG. 28A is displayed, and the locking member 41*b* is rotated in the unlocking direction D3-2 under control of the drawer's-side controller 701. As a result, the drawer 41 is pushed in the drawing direction D2.

In this case, the distance L1 illustrated in FIG. 27 is set to a length longer than the length by which the drawer 41 is pushed in the pushing operation mentioned above. Therefore, after the locking member 41*b* is rotated and thereby the drawer 41 is pushed, the first photosensor 712*a* achieves the ON state, but the second photosensor 712*b* maintains the OFF state.

The guide image GI-1 illustrated in FIG. 28A is displayed until the user further draws the drawer 41 to an extent such that the second photosensor 712*b* achieves the ON state. Namely, the guide image GI-1 which is the animation image is repeatedly displayed. When the drawer 41 is completely drawn and the second photosensor 712*b* achieves the ON state, the guide image GI-1 is switched to the guide image GI-2 illustrated in FIG. 28B. This switching is performed under control of the controller 23 when the controller is notified of the detection results of the first photosensor 712*a* and the second photosensor 712*b*.

Thus, the drawer unit of this embodiment includes the first photosensor 712*a* and the second photosensor 712*b* to detect two positions of the drawer 41, and therefore the guide images can be switched depending on the progress of the jamming resolving processes of the user. Therefore, the user can perform the jamming resolving processes (i.e., drawing the drawer 41 and removing the jammed recording medium sheet) while watching the guide images.

The four embodiments mentioned above are representative embodiments of this disclosure, and this disclosure is not limited thereto. Additional modifications and variations of this disclosure are possible in light of the above teachings. It is therefore to be understood that within the scope of the appended claims this disclosure may be practiced other than as specifically described herein.

For example, the four embodiments mentioned above relate to a drawer unit 40 installed in an image forming apparatus. However, the drawer unit of this disclosure is not limited thereto. For example, the drawer unit can be installed in a desk or a cabinet. Namely, the configuration of the drawer unit of this disclosure is not particularly limited as long as the drawer unit includes a drawer and a housing.

In addition, in the drawer unit 40 of the four embodiments mentioned above, the locking member 41*b* is mounted on the drawer 41, and the locking wall 423 and the pushing wall 423*e* are formed on the housing 42. However, the drawer unit of this disclosure is not limited thereto. For example, the drawer unit can have a configuration such that the locking member is mounted on the housing, and the locking wall and the pushing wall are formed on the drawer. However, as mentioned above, the inner space of the drawer unit can be effectively used when the drawer unit has a configuration such that the locking member is mounted on the drawer, and the locking wall and the pushing wall are formed on the housing. In the drawer unit having a configuration such that the locking member is mounted on the housing, and the locking wall and the pushing wall are formed on the drawer, the positional relationship between the locking wall and the pushing wall, and the slanting direction of the pushing wall are opposite to those in the drawer unit mentioned above in the four embodiments.

In the four embodiments mentioned above, an image forming apparatus, which is a multifunctional periphery having a color printing function and a copying function, is exemplified as the image forming apparatus of this disclosure. However, the image forming apparatus of this disclosure is not limited thereto. For example, the image forming apparatus of this disclosure can be a printer, a copier, a facsimile or the like, which produces monochromatic images or color images.

Effect of This Disclosure

The drawer unit of this disclosure can be used for image forming apparatus and can be drawn by a reduced drawing force.

What is claimed is:

1. A drawer unit comprising:

a housing;

a drawer, insertable into the housing in an inserting direction and configured to be drawn from the housing in a drawing direction opposite to the inserting direction;

a locking member mounted on one of the housing and the drawer; and a locking wall and a pushing wall, mounted on another of the housing and the drawer on which the locking member is not mounted, wherein the locking member extends in a direction intersecting the inserting direction, and is rotatable on a rotating shaft extending in the inserting direction in such a manner that when the drawer is inserted into the housing, the locking member rotates from an unlock position to a lock position in a locking direction, the locking member being rotatable from the lock position to the unlock position in a first unlocking direction prior to drawing of the drawer from the housing, wherein when the locking member is in the lock position, the locking member is engaged with the locking wall, and wherein when the locking member is rotated in the first unlocking direction, the locking member is contacted with the pushing wall, and the pushing wall is inclined to the drawing direction so as to push the drawer in the drawing direction as the locking member rotates in the unlocking direction.

2. The drawer unit according to claim 1, further comprising:

a drawing wall mounted on the another of the housing and the drawer, wherein the drawing wall is located on an upstream side from the locking wall relative to the locking direction so as to be adjacent to the locking wall, and wherein when the locking member is rotated in the locking direction, the locking member is contacted with the drawing wall, and the drawing wall draws the drawer in the inserting direction as the locking member rotates.

3. The drawer unit according to claim 1, wherein the housing serves as part of an image forming apparatus in which a toner image is formed on a surface of a recording medium sheet, and one or more of constituent parts of the image forming apparatus are mounted on the drawer, wherein the locking member is rotatable in a second unlocking direction opposite to the first unlocking direction, wherein a rotation angle at which the locking member is rotated from the lock position to the unlock position via the pushing wall in the first unlocking direction is relatively larger than a rotation angle at which the locking member is rotated from the lock position to the unlock position in the second unlocking direction, wherein when the recording medium sheet jams in the image forming apparatus, the locking member is rotated in the first unlocking direction to unlock the drawer, and wherein the locking member is rotated in the second unlocking direction to unlock the drawer in a case other than jamming of the recording medium sheet.

4. The drawer unit according to claim 1, further comprising:

a drive member to drive the locking member to rotate; and a drive controller to control the drive member such that when the drawer is inserted into the housing, the locking member rotates from the unlock position to the lock position in the locking direction while the locking member rotates from the lock position to the unlock position in the first unlocking direction prior to drawing of the drawer from the housing.

5. The drawer unit according to claim 4, wherein the housing serves as part of an image forming apparatus in which a toner image is formed on a surface of a recording medium sheet, and one or more of constituent parts of the image forming apparatus are mounted on the drawer, wherein the recording medium sheet jams in the image forming apparatus, the image forming apparatus resolves jamming by performing plural processes including a process of drawing the drawer, and wherein the drive controller controls the drive member to rotate the locking member from the lock position to the unlock position in the process of drawing the drawer.

6. The drawer unit according to claim 1, wherein the locking member is mounted on the drawer, and the locking wall and the pushing wall are mounted on the housing.

7. The drawer unit according to claim 6, wherein the locking wall is located in front of the locking member having the lock position relative to the drawing direction, and the pushing wall is located in front of the locking wall relative to the inserting direction while slanting in the drawing direction relative to the first unlocking direction.

8. The drawer unit according to claim 6, further comprising:

a drawing wall mounted on the housing, wherein the drawing wall is located on an upstream side from the locking wall relative to the locking direction so as to be adjacent to the locking wall, wherein when the locking member is rotated in the locking direction, the locking member is contacted with the drawing wall, and the drawing wall draws the drawer in the inserting direction as the locking member rotates, and wherein the drawing wall is connected with the locking wall while slanting in the inserting direction relative to the locking direction.

9. The drawer unit according to claim 1, further comprising:

a first sensor, mounted on the housing to detect the drawer located at an insertion position at which the drawer is completely inserted into the housing; and a second sensor, mounted on the housing to detect the drawer located at a distant position, apart from the insertion position at which the drawer is completely inserted into the housing, at a distance in the drawing direction.

10. An image forming apparatus comprising:

image forming members to form and fix a toner image on a recording medium sheet; and the drawer unit according to claim 1, wherein one or more of the image forming members are mounted on the drawer unit.

11. An image forming apparatus comprising:

image forming members to form and fix a toner image on the recording medium sheet; and the drawer unit according to claim 3, wherein one or more of the image forming members are mounted on the drawer unit.

12. An image forming apparatus comprising:

image forming members to form and fix a toner image on a recording medium sheet; and the drawer unit according to claim 6, wherein one or more of the image forming members are mounted on the drawer unit.

13. An image forming apparatus comprising:

image forming members to form and fix a toner image on the recording medium sheet; and the drawer unit according to claim 8, wherein one or more of the image forming members are mounted on the drawer unit.

14. The drawer unit according to claim 1, wherein the housing serves as part of an image forming apparatus in which a toner image is formed on a surface of a recording medium sheet, wherein the locking member is rotatable in a second unlocking direction opposite to the first unlocking direction, and wherein when the recording medium sheet jams in the image forming apparatus, the locking member is rotated in the first unlocking direction to unlock the drawer, and wherein the locking member is rotated in the second unlocking direction to unlock the drawer in a case other than jamming of the recording medium sheet.

15. An image forming apparatus comprising:

image forming members to form and fix a toner image on the recording medium sheet; and the drawer unit according to claim 14, wherein one or more of the image forming members are mounted on the drawer unit.

16. The drawer unit according to claim 1, further comprising:

a drawing wall mounted on the housing, wherein the drawing wall is located on an upstream side from the locking wall relative to the locking direction so as to be adjacent to the locking wall, wherein when the locking member is rotated in the locking direction, the locking member is contacted with the drawing wall, and the drawing wall draws the drawer in the inserting direction as the locking member rotates, and wherein the drawing wall is connected with the locking wall while slanting in the inserting direction relative to the locking direction.

17. An image forming apparatus comprising:

image forming members to form and fix a toner image on a recording medium sheet; and the drawer unit according to claim 16, wherein one or more of the image forming members are mounted on the drawer unit.

* * * * *